US011684092B2

(12) United States Patent
Roddis et al.

(10) Patent No.: US 11,684,092 B2
(45) Date of Patent: Jun. 27, 2023

(54) PULLOVER BRA

(71) Applicant: The Gap, Inc., Albuquerque, NM (US)

(72) Inventors: Brett Roddis, Berkeley, CA (US); Melissa Lawrence, San Francisco, CA (US); John Kelly, San Francisco, CA (US)

(73) Assignee: The Gap, Inc., San Francisco, CA (US)

( * ) Notice: Subject to any disclaimer, the term of this patent is extended or adjusted under 35 U.S.C. 154(b) by 638 days.

(21) Appl. No.: 16/779,171

(22) Filed: Jan. 31, 2020

(65) Prior Publication Data

US 2020/0323278 A1 Oct. 15, 2020

Related U.S. Application Data

(60) Provisional application No. 62/834,282, filed on Apr. 15, 2019.

(51) Int. Cl.
*A41C 3/00* (2006.01)

(52) U.S. Cl.
CPC ..... *A41C 3/005* (2013.01); *A41C 3/0014* (2013.01)

(58) Field of Classification Search
CPC ..... A41C 3/005; A41C 3/0014
See application file for complete search history.

(56) References Cited

U.S. PATENT DOCUMENTS 3,093,139 A 6/1963 Plehn
6,918,812 B2 * 7/2005 Giese ..... A41C 3/0021 450/75
7,083,494 B2 8/2006 Sandroussi et al.
7,163,432 B2 1/2007 Mitchell et al.
7,442,110 B2 * 10/2008 Gaudet ..... A41C 3/144 450/39
8,075,368 B2 * 12/2011 Puyaubreau ..... A41C 3/14 450/72

(Continued)

FOREIGN PATENT DOCUMENTS

EP 3384790 A1 10/2018
JP 2010-065328 A 3/2010

(Continued)

OTHER PUBLICATIONS

International Searching Authority, International Search Report and Written Opinion for application PCT/US2020/027999, dated Jul. 17, 2020, 12 pgs.

(Continued)

*Primary Examiner* — Gloria M Hale
(74) *Attorney, Agent, or Firm* — Morgan, Lewis & Bockius LLP

(57) ABSTRACT

Pullover bras for high support activities are provided. A bra includes a band that wraps around the torso. The band includes first and second cup regions as well as a gore adjoining the cup regions. An underband runs below the gore and the cup regions. Straps adjoin a respective cup region and a respective portion of the band. A neckline runs above the cup regions and between a first portion of each strap. The gore and underarm portions of the band are formed from a first pattern of fabric. The back of the bra, the straps, and the neckline is formed from a second pattern of fabric. The underband is formed from a third pattern of fabric.

23 Claims, 17 Drawing Sheets

(56) References Cited

U.S. PATENT DOCUMENTS

| | | | | |
|---|---|---|---|---|
| 8,137,155 | B2 * | 3/2012 | Horii | A41C 3/005 450/59 |
| 9,049,890 | B2 | 6/2015 | Starr et al. | |
| 9,149,076 | B2 * | 10/2015 | Almog | A41C 3/06 |
| 9,314,054 | B2 * | 4/2016 | Yuasa | A41C 3/12 |
| 9,538,794 | B2 * | 1/2017 | Turlan | D04B 1/102 |
| 10,179,960 | B2 | 1/2019 | Diaz et al. | |
| 10,201,192 | B1 | 2/2019 | Lott | |
| 2003/0171066 | A1 * | 9/2003 | Mitchell | A41C 5/00 450/66 |
| 2005/0136797 | A1 * | 6/2005 | Mitchell | A41C 5/00 450/60 |
| 2006/0240743 | A1 * | 10/2006 | Mitchell | A41C 5/00 450/1 |
| 2009/0098803 | A1 | 4/2009 | Reinisch et al. | |
| 2011/0212668 | A1 * | 9/2011 | Mitchell | D04B 1/246 450/86 |
| 2020/0232130 | A1 * | 7/2020 | Diaz | A41C 3/0014 |

FOREIGN PATENT DOCUMENTS

| | | | |
|---|---|---|---|
| JP | 2019-019422 | A | 2/2019 |
| WO | WO 2006-110387 | A2 | 10/2006 |

OTHER PUBLICATIONS

Kharkova, et al., "Elastic Properties of Cotton Fabric Based Polymer Composites," *Engineering for Rural Development* (Latvia), May 26-27, 2011, pp. 402-407.

Kordoghli, et al., "Mechanical Behavior of Seams on Treated Fabrics," *AUTEX Research Journal* (Tunisia), 2009, 9(3), pp. 87-92.

Zupin, et al., "Mechanical Properties of Fabrics Made from Cotton and Biodegradable Yarns Bamboo, SPF, PLA in Weft," *Woven Fabric Engineering, Polona Dobnik Dubrovski* (*Ed.*), ISBN: 978-953-307-194-7, *InTech*, Available from: http://www.intechopen.com/books/woven-fabricengineering/mechanical-properties-of-fabrics-made-from-cotton-and-biodegradable-yarns-bamboo-spf-pla-inweft, Aug. 2010, 24 pgs.

* cited by examiner

100

100

100

100

PULLOVER BRA

CROSS-REFERENCE TO RELATED APPLICATION

This application claims priority to U.S. Provisional Patent Application No. 62/834,282, entitled "Pullover Bra," filed Apr. 15, 2019, which is hereby incorporated by reference in its entirety.

TECHNICAL FIELD

The present disclosure relates generally to bras. More particularly, the present disclosure relates to pullover bras.

BACKGROUND

Surveys have indicated that bras have a number of drawbacks, chief among them the difficulty in putting them on and off. Another difficulty highlighted in surveys is that the bras are often too tight or too loose in the chest band. Still another drawback with bras according to surveys is the discomfort experienced due to the weight of the bra pulling on the shoulders and the neck, which can cause cutting into skin. Still another drawback with bras according to surveys is nipple show-through. Moreover, there continues to be a need for improved support and comfort.

Addressing these deficiencies is complicated by the fact that many women have breast asymmetry and that the breast does not contain muscle but rather is comprised of fat and glandular tissue. Addressing these deficiencies is further complicated by the fact that breast movement is complex, with each breast being capable of moving along three different orthogonal axes depending on activity, and the way in which the weight of each breast is distributed differently. Some bras compress the breasts in order to treat the breasts as a singular mass. However, according to surveys, the compression of the breasts leads to discomfort with prolonged use.

Given the above background, what is needed in the art are improved bras to overcome the above identified deficiencies. Such improvements will have the benefit of empowering women. That is, achieving a central goal of enabling every woman to be confident and feel comfortable without limits or distract.

SUMMARY

The present disclosure addresses the above-identified shortcomings. In the present disclosure bras that provide individual support to each breast, as opposed to relying solely on compression support, are provided. In some embodiments, this individual support is provided by encapsulation of breasts, which separates the breasts and treats them as two separate masses, as opposed to compression of the breasts, which compresses the breasts into a single mass and thereby treats the breast, from a support perspective, as this single mass. Moreover, in some embodiments, the presently disclosed bras provide improved load bearing capacities by allowing a designer to vary different portions and regions of the bras using different densities and patterns of fabric through a continuous fabrication process.

A pullover bra of the present disclosure includes a band that is configured to wrap around a torso of a wearer. The band includes a back portion, a first underarm portion, a second underarm portion, and a front portion. The front portion is connected to the back portion through both the first underarm portion and the second underarm portion of the band. Additionally, the front portion includes a first cup region and a second cup region. A gore is formed between the first cup region and the second cup region, which adjoins the first cup region and the second cup region. Further, an underband is formed by the bottom portion of the bra. The underband runs below the gore, the first cup region, and the second cup region. A first strap adjoins the first cup region and a first portion of the back portion of the band. Similarly, a second strap adjoins the second cup region and a second portion of the back portion of the band. A neckline runs above the first cup region and the second cup region as well as running between a first portion of the first strap and a first portion of the second strap. Each of the gore, the first underarm portion, and the second underarm portion is formed from a first pattern of fabric. Each of the back portion of the bra, the first strap, the second strap, and the neckline portion is formed from a second pattern of fabric. Furthermore, the underband is formed from a third pattern of fabric.

In some embodiments, each respective cup in a set consisting of the first cup region and the second cup region is formed with a density of stitching that decreases from a base of the respective cup to a top of the respective cup.

In some embodiments, the density of stitching decreases as a linear or nonlinear gradient of stitching density from the base of the respective cup to the top of the respective cup.

In some embodiments, the density of stitching decreases from a first density at a first portion of the respective cup at the base of the respective cup to a second density at a second portion of the respective cup at the top of the respective cup.

In some embodiments, the respective cup includes a third portion between the first portion and the second portion of the respective cup that is stitched at a third density. In some embodiments, the third density is between first density and the second density.

In some embodiments, the respective cup includes a fourth portion between the third portion and the second portion of the respective cup that is stitched at a fourth density. In some embodiments, the fourth density is between the third density and the second density.

In some embodiments, a top portion of each of the first strap and the second strap is formed from the first pattern of fabric.

In some embodiments, a top portion of each of the first strap and the second strap is formed from a fourth pattern of fabric.

In some embodiments, the first pattern of fabric, the second pattern of fabric, the third pattern of fabric, and the fourth pattern of fabric is each independently defined by a unique stitching thickness, a unique type of stitching, a blend of material, or a combination thereof.

In some embodiments, an upper portion of the back portion of the bra is formed from the second pattern of fabric. Additionally, a bottom portion of the back portion of the bra is formed from a fifth pattern of fabric.

In some embodiments, the first pattern of fabric, the second pattern of fabric, the third pattern of fabric, the fourth pattern of fabric, and the fifth pattern of fabric is each independently defined by a unique stitching thickness, a unique type of stitching, a blend of material, or a combination thereof.

In some embodiments, the neckline portion is formed from the fifth pattern of fabric.

In some embodiments, the neckline portion is formed from a sixth pattern of fabric.

In some embodiments, the first, second, third, fourth, fifth and sixth pattern of fabric is each independently defined by a unique stitching thickness, a unique type of stitching, a blend of material, or a combination thereof.

In some embodiments, a first gusset is formed at an outer edge portion of the first cup region proximate to the first underarm portion. Accordingly, in some embodiments a second gusset is formed at an outer edge portion of the second cup region proximate to the second underarm portion.

In some embodiments, each of the first gusset and the second gusset is formed from the first pattern of fabric.

In some embodiments, an auxiliary gusset is formed adjoining the underband to the back portion, the first underarm portion, the second underarm portion, and front portion of the bra.

In some embodiments, the auxiliary gusset is formed from a seventh pattern of fabric. In some embodiments, the seventh pattern of fabric has a modulus that is lower than that of the third pattern of fabric.

In some embodiments, the first, second, third, fourth, fifth, sixth and seventh pattern of fabric is each independently defined by a unique stitching thickness, a unique type of stitching, a blend of material, or a combination thereof.

In some embodiments, the first, second, and third pattern of fabric is each independently defined by a unique stitching thickness, a unique type of stitching, a blend of material, or a combination thereof.

In some embodiments, the unique type of stitching is pique stitch, a mesh stitch, or rib stitch.

In some embodiments, the first and second bra cup regions are formed from a blend of material that includes low melt yarn.

In some embodiments, the bra is manufactured using a circular kitting machine in a continuous uninterrupted process.

In some embodiments, the bra is formed as a seamless bra.

Another aspect of the present disclosure is directed to providing a pullover bra that includes a band which wraps around a torso of a wearer. The band includes a back portion, a first underarm portion, a second underarm portion, and a front portion. The front portion is connected to the back portion through both of the first underarm portion and the second underarm portion of the band. Additionally, the front portion includes a first cup region and a second cup region. A gore is formed between the first cup region and the second cup region, which adjoins the first cup region and the second cup region. Further, an underband is formed by the bottom portion of the bra. The underband runs below the gore, the first cup region, and the second cup region. A first strap adjoins the first cup region and a first portion of the back portion of the band. Similarly, a second strap adjoins the second cup region and a second portion of the back portion of the band. A neckline runs above the first cup region and the second cup region as well as running between a first portion of the first strap and a first portion of the second strap. Each of the gore, the first underarm portion, and the second underarm portion is formed from a first pattern of fabric. Each of the back portion of the bra, the first strap, the second strap, and the neckline portion is formed from a second pattern of fabric.

Yet another aspect of the present disclosure is directed to providing a pullover bra that includes a band which wraps around a torso of a wearer. The band includes a back portion, a first underarm portion, a second underarm portion, and a front portion. The front portion is connected to the back portion through both of the first underarm portion and the second underarm portion of the band. Additionally, the front portion includes a first cup region and a second cup region. A gore is formed between the first cup region and the second cup region, which adjoins the first cup region and the second cup region. Further, an underband is formed by the bottom portion of the bra. The underband runs below the gore, the first cup region, and the second cup region. A first strap adjoins the first cup region and a first portion of the back portion of the band. Similarly, a second strap adjoins the second cup region and a second portion of the back portion of the band. A neckline runs above the first cup region and the second cup region as well as running between a first portion of the first strap and a first portion of the second strap. Each of the gore, the first underarm portion, and the second underarm portion is formed from a first pattern of fabric.

Yet another aspect of the present disclosure is directed to providing a pullover bra that includes a band which wraps around a torso of a wearer. The band includes a back portion, a first underarm portion, a second underarm portion, and a front portion. The front portion is connected to the back portion through both of the first underarm portion and the second underarm portion of the band. Additionally, the front portion includes a first cup region and a second cup region. A gore is formed between the first cup region and the second cup region, which adjoins the first cup region and the second cup region. Further, an underband is formed by the bottom portion of the bra. The underband runs below the gore, the first cup region, and the second cup region. A first strap adjoins the first cup region and a first portion of the back portion of the band. Similarly, a second strap adjoins the second cup region and a second portion of the back portion of the band. A neckline runs above the first cup region and the second cup region as well as running between a first portion of the first strap and a first portion of the second strap. Each of the gore, the first underarm portion, the second underarm portion, the back portion of the bra, the first strap, the second strap, the neckline portion, and the underband is respectively formed from one of a first pattern of fabric, a second pattern of fabric, or a third pattern of fabric.

Yet another aspect of the present disclosure is directed to providing a pullover bra that includes a band which wraps around a torso of a wearer. The band includes a back portion, a first underarm portion, a second underarm portion, and a front portion. The front portion is connected to the back portion through both of the first underarm portion and the second underarm portion of the band. Additionally, the front portion includes a first cup region and a second cup region. A gore is formed between the first cup region and the second cup region, which adjoins the first cup region and the second cup region. Further, an underband is formed by the bottom portion of the bra. The underband runs below the gore, the first cup region, and the second cup region. A first strap adjoins the first cup region and a first portion of the back portion of the band. Similarly, a second strap adjoins the second cup region and a second portion of the back portion of the band. A neckline runs above the first cup region and the second cup region as well as running between a first portion of the first strap and a first portion of the second strap. Each of the gore, the first underarm portion, the second underarm portion, the back portion of the bra, the first strap, the second strap, the neckline portion, and the underband is respectively formed from one of a first pattern of fabric, a second pattern of fabric, a third pattern of fabric, a fourth pattern of fabric, a fifth pattern of fabric, a sixth pattern of fabric, or a seventh pattern of fabric.

Yet another aspect of the present disclosure is directed to providing a pullover bra that includes a band which wraps around a torso of a wearer. The band includes a back portion, a first underarm portion, a second underarm portion, and a front portion. The front portion is connected to the back portion through both of the first underarm portion and the second underarm portion of the band. Additionally, the front portion includes a first cup region and a second cup region. A gore is formed between the first cup region and the second cup region, which adjoins the first cup region and the second cup region. Further, an underband is formed by the bottom portion of the bra. The underband runs below the gore, the first cup region, and the second cup region. A neckline runs above the first cup region and the second cup region.

Yet another aspect of the present disclosure is directed to providing a pullover bra that includes a set of encapsulating cup regions. Further, the pullover bra includes low melt yarn and is fabricated using a circular knitting machine.

BRIEF DESCRIPTION OF THE DRAWINGS

The embodiments disclosed herein are illustrated by way of example, and not by way of limitation, in the figures of the accompanying drawings. Like reference numerals refer to corresponding parts throughout the drawings.

DESCRIPTION OF EMBODIMENTS

Figure 1:
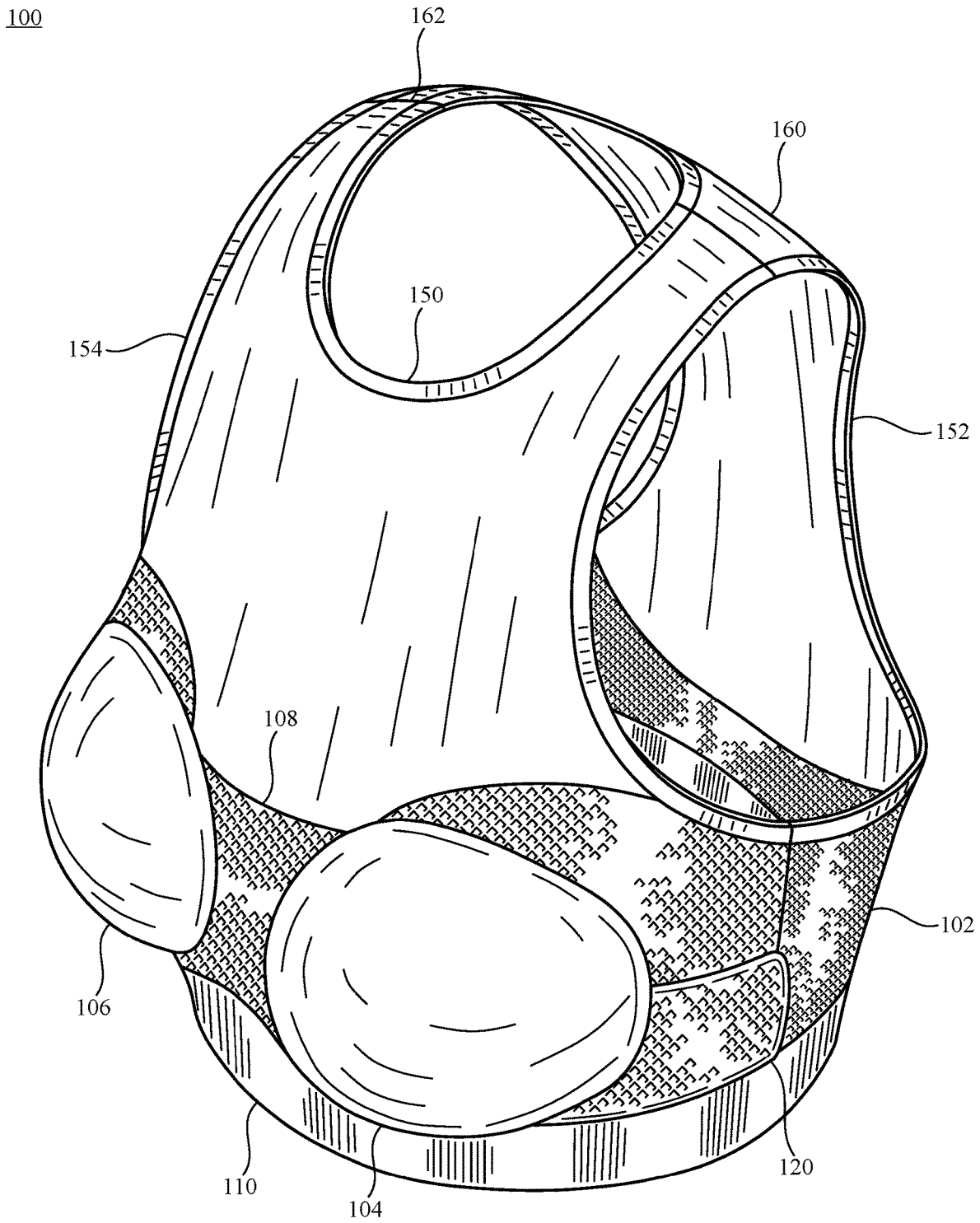
FIG. 1 illustrates a first view of a bra in accordance with an embodiment of the present disclosure.

The present disclosure provides pullover bras for use in high impact activities. A bra includes a band that wraps around a torso of a wearer. The band is defined by a back portion, a first underarm portion, a second underarm portion, and a front portion. The front portion and the back portion are connected to each other through both of the first underarm portion and the second underarm portion. The front portion includes first and second cup regions that each accommodate a respective breast of the wearer. Further, a gore is formed between the first and second cup regions, which adjoins the respective cup regions together. Additionally, an underband is formed by the bottom portion of the bra that runs below each of the gore and cup regions. A first strap adjoins the first cup region and a first portion of the back portion of the band. Similarly, a second strap adjoins the second cup region and a second portion of the back portion of the band. Furthermore, a neckline portion runs above the first cup region and the second cup region and also runs between a first portion of the first strap and a first portion of the second strap. In fabricating the bra, each of the gore, the first underarm portion, and the second underarm portion is formed from a first pattern of fabric. Each of the back portion of the bra, the first strap, the second strap, and the neckline portion is formed from a second pattern of fabric. Furthermore, the underband is formed from a third pattern of fabric.

Accordingly, the present disclosure provides a bra that encapsulates each breast as a discrete mass. This individualized encapsulation of each breast provides an improved comfort to the wearer, and allows dampening of the movement of the breasts during medium and high impact activities, such as running or swimming, instead of compressing the breasts as a single mass. Furthermore, since the bras of the present disclosure are fabricated as a seamless pullover bra, different patterns of fabric can be disposed throughout various portions of the bra to tailor a level of support of the breasts. The bras in accordance with some embodiments of the present disclosure utilize a low melt yarn that is included in various portions of the bra to provide support for the breasts. Advantageously, the use of low melt yarn allows for the bra to be fabricated without requiring a cradle under the breasts.

Reference will now be made in detail to embodiments, examples of which are illustrated in the accompanying drawings. In the following detailed description, numerous specific details are set forth in order to provide a thorough understanding of the present disclosure. However, it will be apparent to one of ordinary skill in the art that the present disclosure may be practiced without these specific details. In other instances, well-known methods, procedures, components, circuits, and networks have not been described in detail so as not to unnecessarily obscure aspects of the embodiments.

Plural instances may be provided for components, operations or structures described herein as a single instance. Finally, boundaries between various components are somewhat arbitrary, and particular operations are illustrated in the context of specific illustrative configurations. Other forms of functionality are envisioned and may fall within the scope of the implementation(s). In general, structures and functionality presented as separate components in the example configurations may be implemented as a combined structure or component. Similarly, structures and functionality presented as a single component may be implemented as separate components. These and other variations, modifications, additions, and improvements fall within the scope of the implementation(s).

It will also be understood that, although the terms "first," "second," etc. may be used herein to describe various elements, these elements should not be limited by these terms. These terms are only used to distinguish one element from another. For example, a first pattern of fabric could be termed a second pattern of fabric, and, similarly, a second pattern of fabric could be termed a first pattern of fabric, without departing from the scope of the present disclosure.

The first pattern of fabric and the second pattern of fabric are patterns of fabric, but they are not the same pattern of fabric.

The terminology used herein is for the purpose of describing particular embodiments only and is not intended to be limiting of the claims. As used in the description of the embodiments and the appended claims, the singular forms "a", "an" and "the" are intended to include the plural forms as well, unless the context clearly indicates otherwise. It will also be understood that the term "and/or" as used herein refers to and encompasses any and all possible combinations of one or more of the associated listed items. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

As used herein, the term "fabric" means a material used in the construction of the present disclosure. Fabrics include natural fibers (e.g., cotton, hemp, flax, fur, jute, linen, silk, wool, etc.) and/or synthetic fibers (e.g., latex, nylon, polyester, polyurethane, rayon, rubber, silicon, spandex, etc.), or a blend thereof. Additionally, these fabrics may have any suitable weave used in the art (e.g., twill weave, plain weave, satin weave, etc.), or have any suitable bonding or felting used in the art. Moreover, unless expressly stated otherwise, the term "fabric" includes general materials used in productions of garments such as elastics, metals, and plastics.

Further, as used herein, the term "right" means a right hand side with respect to a perspective of a wearer of a bra of the present disclosure. Similarly, as used herein, the term "left" means a left hand side with respect to the perspective of the wearer of the bra of the present disclosure.

The foregoing description, for purpose of explanation, has been described with reference to specific embodiments. However, the illustrative discussions below are not intended to be exhaustive or to limit the embodiments to the precise forms disclosed. Many modifications and variations are possible in view of the above teachings. The embodiments are chosen and described in order to best explain the principles and their practical applications, to thereby enable others skilled in the art to best utilize the embodiments and various embodiments with various modifications as are suited to the particular use contemplated.

In the interest of clarity, not all of the routine features of the embodiments described herein are shown and described. It will be appreciated that, in the development of any such actual implementation, numerous implementation-specific decisions are made in order to achieve the designer's specific goals, such as compliance with use case- and business-related constraints, and that these specific goals will vary from one implementation to another and from one designer to another. Moreover, it will be appreciated that such a design effort might be complex and time-consuming, but nevertheless be a routine undertaking of engineering for those of ordering skill in the art having the benefit of the present disclosure.

For convenience in explanation and accurate definition in the appended claims, the terms "upper," "lower," "up," "down," "upwards," "downwards," "laterally, "longitudinally," "inner," "outer," "inside," "outside," "inwardly," "outwardly," "interior," "exterior," "front," "rear," "back," "forwards," and "backwards" are used to describe features of the exemplary embodiments with reference to the positions of such features as displayed in the figures.

In some embodiments, the present disclosure provides a variety of bras for use by a wearer. However, the present disclosure is not limited thereto. For instance, in some embodiments the present disclosure provides a variety of swimsuit tops (e.g., a bikini top). In other embodiments, the present disclosure may be integrally combined with an article of clothing, for example, a blouse, a dress, a shirt, a wetsuit, etc. Furthermore, in some embodiments of the present disclosure, various aspects of the of the present disclosure are relatable to other types of garments, such as pants (e.g., yoga pants) and socks.

Figure 2:
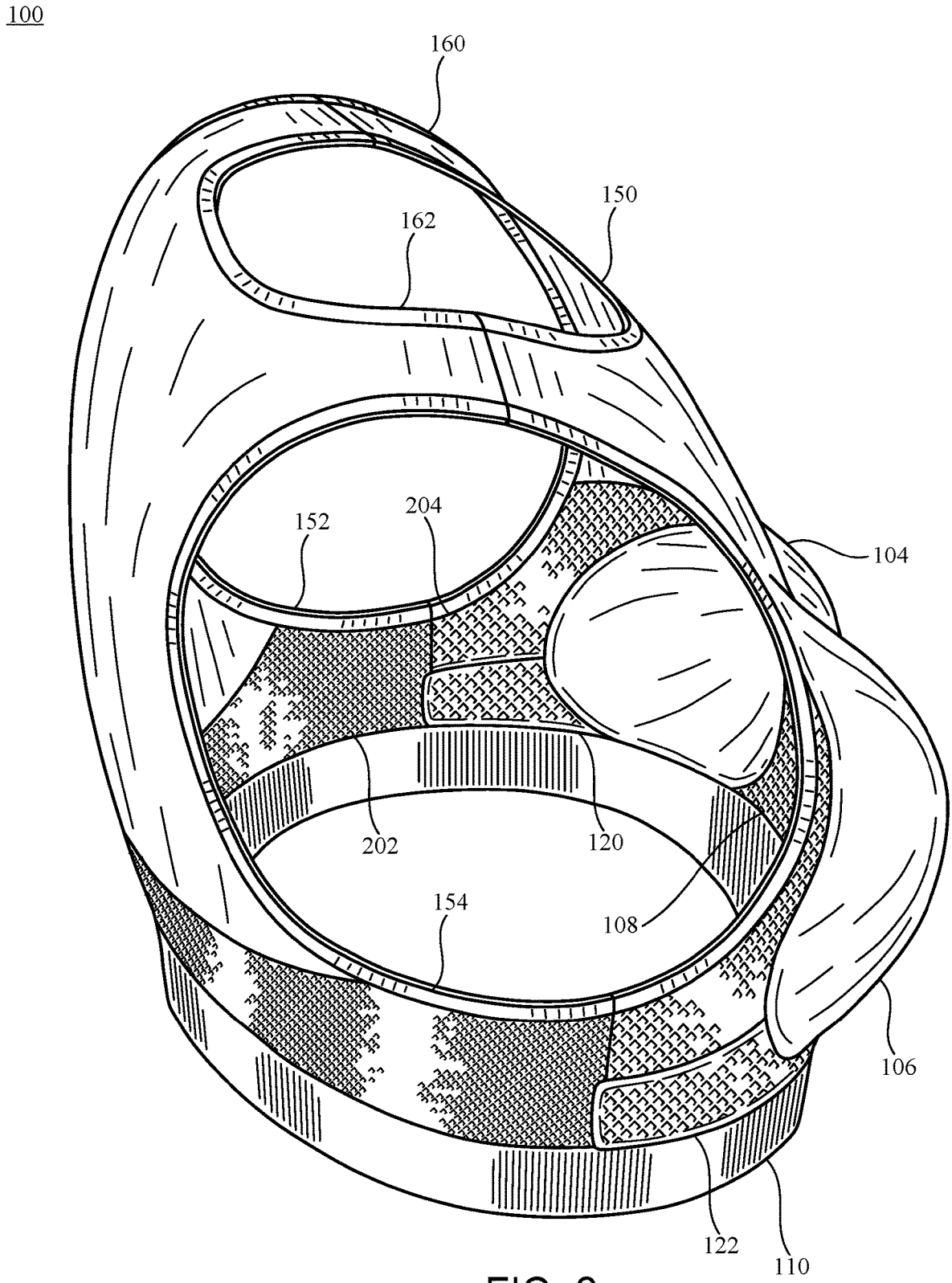
FIG. 2 illustrates a second view of the bra of FIG. 1.
Figure 3:
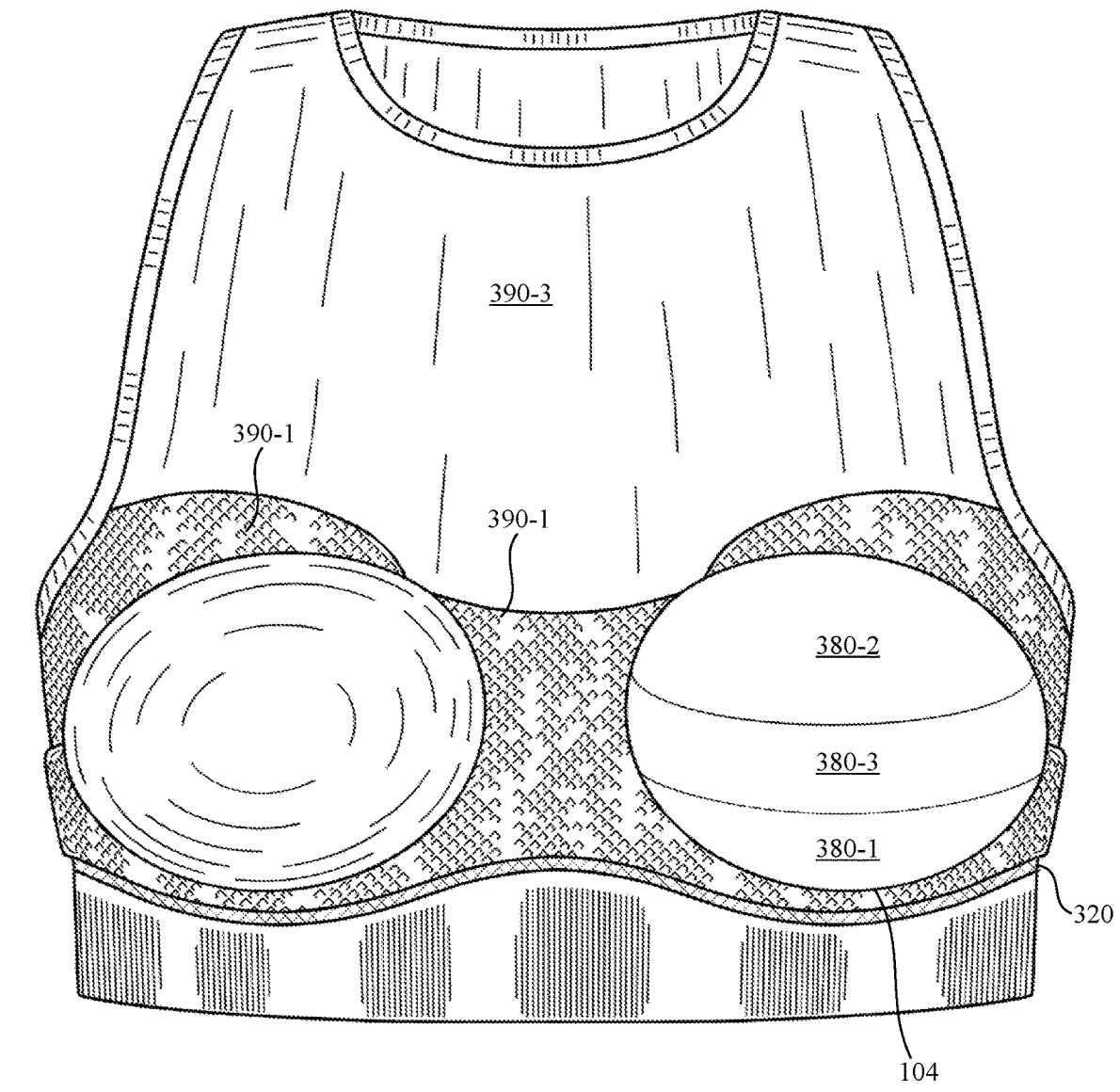
FIG. 3 illustrates a front view of another bra in accordance with an embodiment of the present disclosure.
Figure 4:
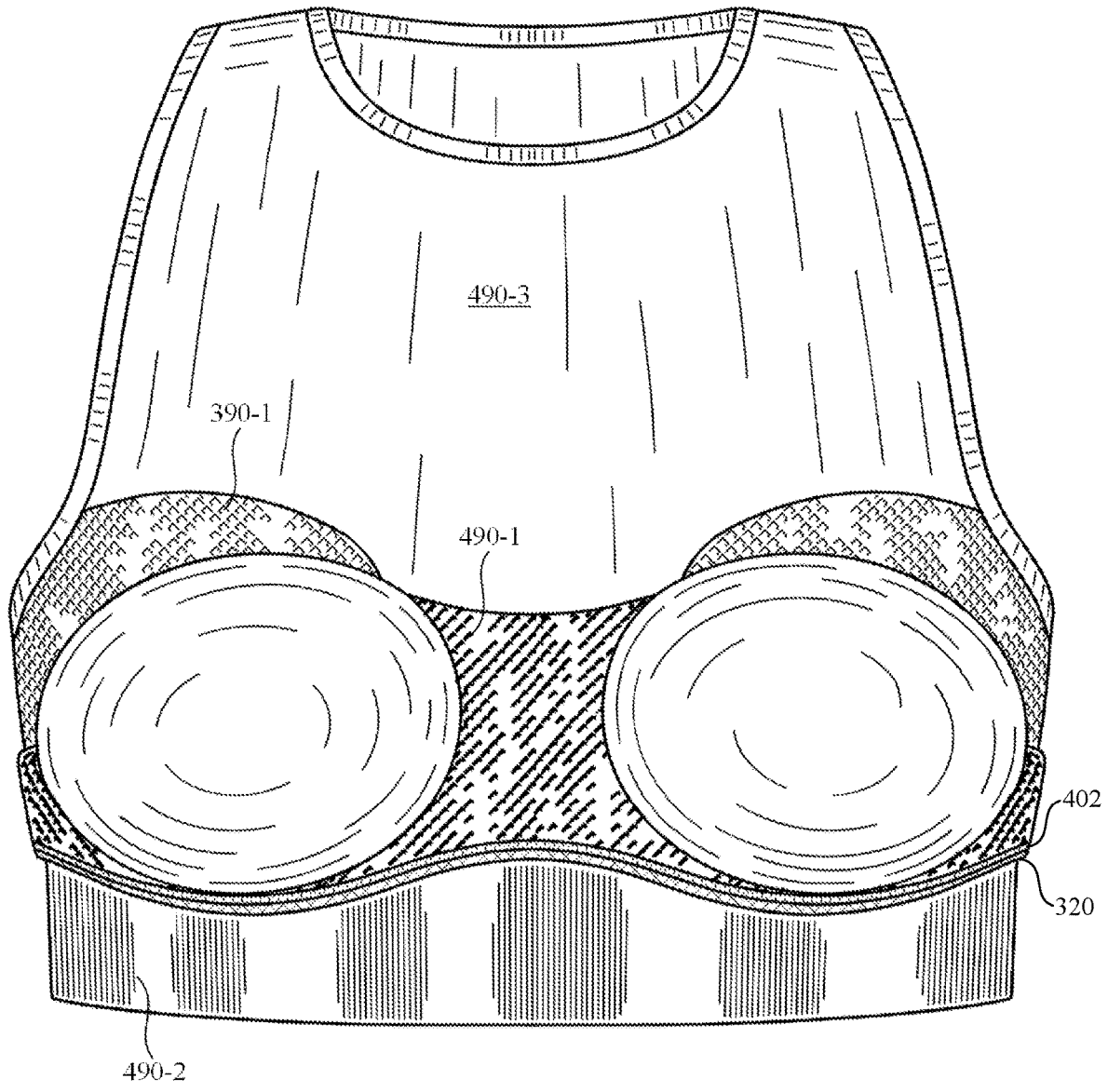
FIG. 4 illustrates a front view of yet another bra in accordance with an embodiment of the present disclosure.

Referring to FIG. 1 through FIG. 3, a bra 100 is illustrated in accordance with various embodiments of the present disclosure. The bra 100 includes a band 102 that wraps around a torso of a wearer. The band 102 includes a back portion that is proximate to a spine of the wearer, a front portion that is proximate to the breasts of the wearer, and respective underarm portions that correspond to each arm of the wearer. Accordingly, the front portion of the band 102 is connected to the back portion of the band through the respective underarm portions. Preferably, these connections from the front portion and the back portion to the respective underarm portions of the band 102 are integrally formed as a continuous portion of the bra using one or more fabrics or formed as a molded piece. However, the present disclosure is not limited thereto. For instance, in some embodiments these connections of the band 102 are sewn or bonded (e.g., includes a reinforcement such as reinforcement 1206 of FIG. 12). Nevertheless, in various embodiments in which the band 102 is formed as a continuous portion of one or more fabrics (e.g., a loop of one or more fabrics) and fully encapsulates the various components of the bra 100, including the front portion, the back portion, and the respective underarm portions. This continuity of the band 102 allows for the wearer to pull the bra 100 (e.g., the bra is a pull-on type bra) by placing their head and arms through the band and pulling the bra downwardly towards their torso and/or hips. Additional details and information regarding the fabrication of a bra 100 of the present disclosure will be described in more detail infra.

In various embodiments, the band 102 includes corresponding cup regions (e.g., a first cup region 104 and a second cup region 106). These cup regions 104 and 106 are utilized to support, surround, lift, encapsulate, and/or cover the breasts of the wearer. In some embodiments, the respective cup regions 104 and 106 impart an ornamental effect on the bra 100. This ornamental effect includes at least a shape of the respective cup regions 104 and 106 and a texture (e.g., a stitch density, a stitch type, etc.) of the one or more fabrics utilized in fabricating the respective cup regions. In various embodiments, and with reference to FIG. 1 through FIG. 3, the cup regions 104 and 106 are formed with a similar size and a similar shape (e.g., both of the first cup region 104 and the second cup region 106 are formed with a same cup size). However, the present disclosure is not limited thereto. For instance, in some embodiments, such as when the breasts of the wearer are asymmetric, one region (e.g., the first cup region 104) is formed with a different size cup than the other cup region (e.g., the first cup region is smaller than the second cup region, or the first cup region is larger than the second cup region). Similarly, in some embodiments one cup region (e.g., the first cup region 104) is formed in a different shape than the other cup region cup region 106. For instance, in some embodiments each cup region is shaped in an identical manner (e.g., each cup region is perfectly symmetric), whereas in other embodiments each cup region is shaped in a manner that is symmetric about a vertical plane (e.g., the cup shapes are mirror images of each other). Cup shapes include, but are not limited to, balconette cups, balcony cups, contour cups, demi cups, full cups, lined cups, minimizer cups, nursing cups, padded cups, petite cups, plunge cups, push-up cups, seamed cups, and soft cups. In some embodiments, the respective cup regions 104 and 106 are formed in a spheroidal shape, an ellipsoidal shape, or a shape of an approximate three-dimensional (3D) Reuleaux triangle. The exact cup shape is determined by accounting for at least a required level of support of the breasts as well as the ornamental affect imparted by the cup shape. Furthermore, in some embodiments each of the cup regions 104 and 106 is formed seamless. However, the present disclosure is not limited thereto. For instance, in some embodiments each of the cup regions 104 and 106 is formed with a vertical seam, a three-part seam, a part-seam, or the like.

Furthermore, in some embodiments each respective cup region 104 and 106 includes an embroidery formed on an outer surface thereof. In some embodiments, such as that of a stitched or lace embroidery, the embroidery protrudes from the outer surface of the respective cup region 104 and 106 by a height (e.g., there exists a difference in height between the embroidery and a respective cup region 104 or 106). In some embodiments, the difference in height between the embroidery and a respective cup region is less than or equal to 0.25 millimeters (mm). In some embodiments, the difference in height between the embroidery and a respective cup region is less than or equal to 0.5 mm. In some embodiments, the difference in height between the embroidery and a respective cup region is less than or equal to 0.75 mm. In some embodiments, the difference in height between the embroidery and a respective cup region is less than or equal to 0.1 mm. In some embodiments, the difference in height between the embroidery and a respective cup region is less than or equal to 0.5 mm. In some embodiments, the difference in height between the embroidery and a respective cup region is less than or equal to 0.75 mm. In some embodiments, the difference in height between the embroidery and a respective cup region is less than or equal to 1 mm. In some embodiments, the difference in height between the embroidery and a respective cup region is less than or equal to 2 mm. In some embodiments, the difference in height between the embroidery and a respective cup region is less than or equal to 3 mm.

Figure 14:
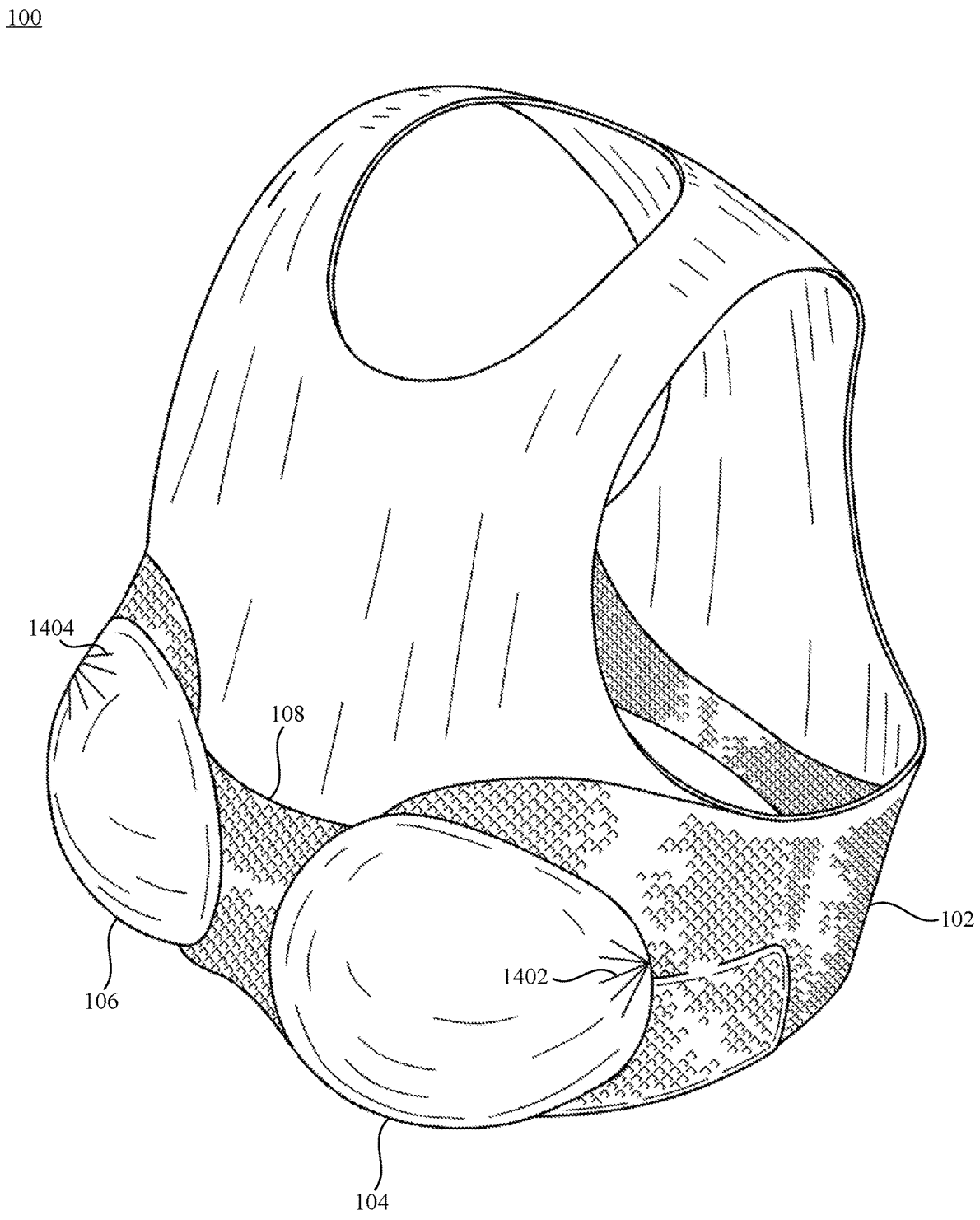
FIG. 14 illustrates yet another view of a further bra in accordance with an embodiment of the present disclosure.

Referring briefly to FIG. 14, in some embodiments each respective cup region 104 and 106 includes a plurality of lined stitches that reinforce a rigidity of the respective cup region and provide a three-dimensional projection to the respective cup region. In some embodiments, the plurality of lined stitches of the respective cup region include one or more lines of stitching that radiate outwardly from a similar, or approximately similar, origin as each other lined stitch in the plurality of lined stitches (e.g., each lined stitch in the plurality of lined stitches intersects, or would interest if projected further, at a particular point). Accordingly, in some embodiments the first cup region 104 includes a first plurality of lined stitches 1402 and the second cup region 106 includes a second plurality of lined stitches 1404. Nevertheless, in some embodiments, the plurality of lined stitches includes a first lined stitch that radiates from the origin to an upper end portion of the respective cup region. In some embodiments, the plurality of lined stitches includes a second lined stitch that radiates from the origin to a lower end portion of the respective cup region. Further, in some embodiments the plurality of lined stitches of each respective cup region radiate at a first half of the respective cup region, but do not radiate in a second half of the respective cup region (e.g., the plurality of lined stitches to not cross a vertical axis of the respective cup region. Additionally, in some embodiments the plurality of lined stitches of each respective cup region includes a number of lined stitches in a range of from 1 lined stitch to 10 lined stitches. In some embodiments, the plurality of lined stitches of each respective cup region includes a number of lined stitches in a range of from 2 lined stitches to 8 lined stitches. In some embodiments, the plurality of lined stitches of each respective cup region includes a number of lined stitches in a range of from 3 lined stitches to 6 lined stitches. In some embodiments, the plurality of lined stitches of each respective cup region includes 5 lined stitches.

Referring back to FIG. 1, a gore 108 is formed between the first cup region 104 and the second cup region 106. The gore 108 is configured to adjoin the first cup region 104 and the second cup region 106 together, forming a bridge there between. During use, the gore 108, or at least a portion of the gore, lies flat against and abuts a chest of the wearer, in between the breasts and proximate to the sternum of the wearer.

In various embodiments, each of the cup regions 104 and 106 and the gore 108 combine to create a neckline portion on the front portion of the band 102. As described supra, each cup region 104 and 106 is formed in any of a variety of shapes (e.g., a padded shape, a petite shape, a push-up shape), and, in collective combination with the gore 108, is responsible for forming a shape of the neckline portion. In some embodiments, the shape of the neckline portion is formed, at least in part, by the band 102. The shape of the neckline portion includes shapes such as a full neckline, a part-full neckline, a balconette neckline, a half-cup neckline, a plunge neckline, etc. Further, in some embodiments the neckline portion of the bra 100 is a high-neckline, in which the neckline portion of the bra covers a majority or all of an intermammary cleft of the wearer. However, the present disclosure is not limited thereto. For instance, in some embodiments the neckline portion of the bra 100 is a mid-neckline portion or a low-neckline, in which the neckline portion of the bra covers some or a minority of the intermammary cleft of the wearer. In some embodiments, the shape of the neckline portion in various embodiments of the bra 100 is largely ornamental since a significant portion of support for the breasts of the wearer is borne by other portions (e.g., the cup regions, an underband) of the bra. However, the present disclosure is not limited thereto. For instance, in some embodiments the neckline portion provides additional support to the breasts of the wearer. Additional details and information related to the various support mechanisms of the bra 100 will be described in more detail infra.

Figure 15:
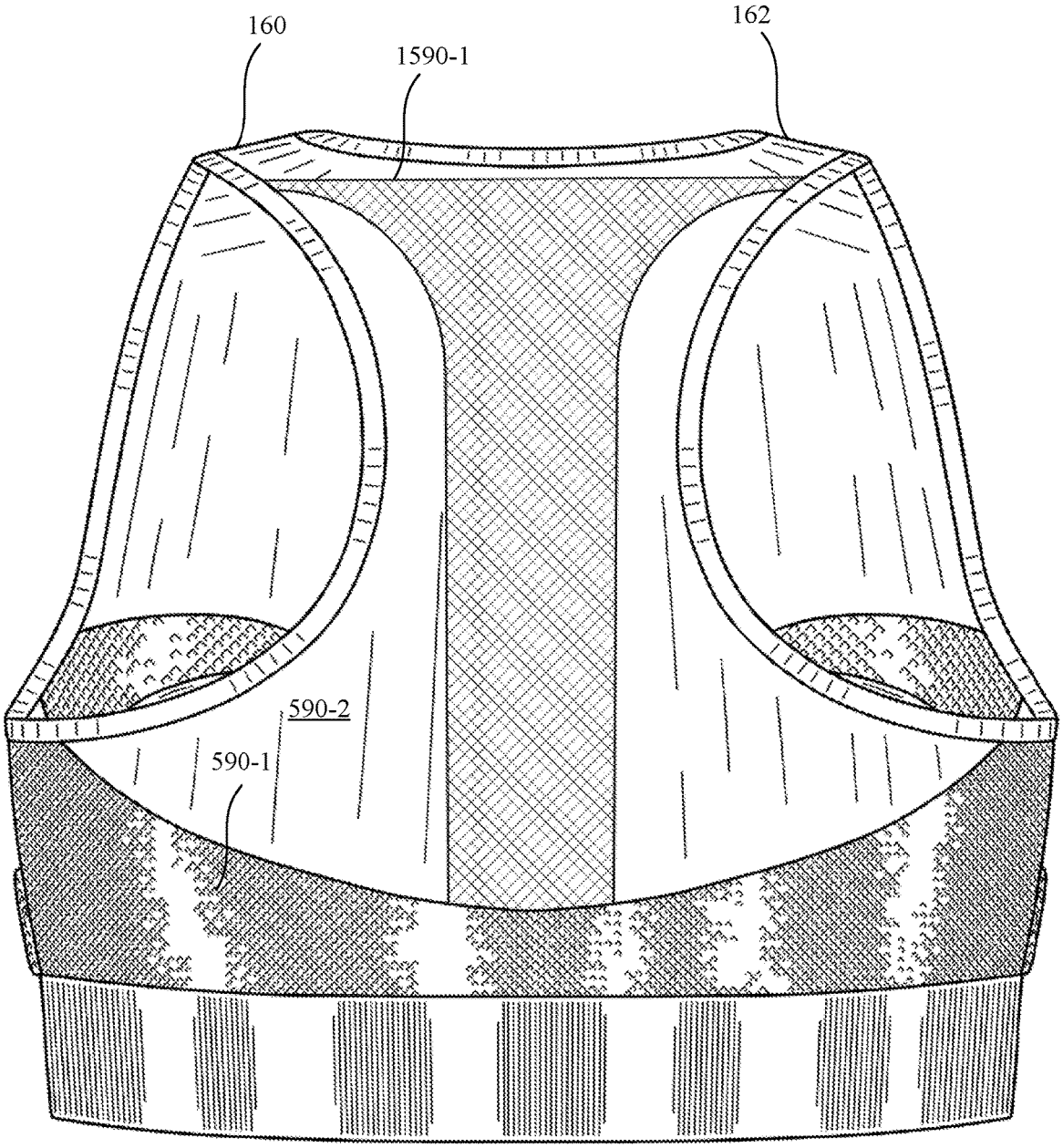
FIG. 15 illustrates a back view of year another bra in accordance with an embodiment of the present disclosure.

Referring briefly to FIG. 15, in some embodiments the back portion of the band 102 includes a first portion (e.g., an upper portion 590-2) and a second portion (e.g., lower portion 590-3) that surround a back of the wearer. Moreover, in some embodiments the back portion of the band 102 includes a third portion (e.g., a middle portion 1590-1). In some embodiments, the middle portion 1590-1 runs a length of the back portion of the band 102 from an upper end portion of the back of the band to a lower end portion of the back of the band. Furthermore, as illustrated in FIG. 15, in some embodiments the middle portion 1590-1 spans from a first side portion of the back portion of the band 102 (e.g., from a portion of the first strap 160) to a second side portion of the back of the band (e.g., from a portion of the second strap 160). In some embodiments, the middle portion 1590-1 includes a first portion that extends upwardly and a second that extends outwardly (e.g., outwardly to a left and/or a right of the wearer). In some embodiments, the first portion of the middle portion 1590-1 has a width in a range of from 0.2 cm to 10 cm. In some embodiments, the first portion of the middle portion 1590-1 has a width in a range of from 0.5 cm to 10 cm. In some embodiments, the first portion of the middle portion 1590-1 has a width in a range of from 0.5 cm to 8 cm. In some embodiments, the first portion of the middle portion 1590-1 has a width in a range of from 1 cm to 8 cm. Furthermore, in some embodiments, the middle portion 1590-1 has a length that spans the length of the bra 100. In some embodiments, the middle portion has a length that spans from an upper end portion of the back of the band 102 to a portion of the lower portion 590-1 of the back portion of the band. In some embodiments, the middle portion has a length that spans from an upper end portion of the back of the band 102 to an upper end portion of underband 110.

In various embodiments, the bottom portion of the band 102 forms an underband 110. The underband 110 provides support for the breasts of the wearer and dampens movement of the bra 100 during use. When the underband 110 is present, it is formed below the respective cup regions 104 and 106. The underband 110 has an inner surface, which is in contact with the torso of the wearer during use, and an outer surface with is largely ornamental. The inner surface and the outer surface of the underband 110 are not necessarily of a single layer of fabric, as in some embodiments the underband is formed from a variety of layers of fabric. Nevertheless, in some embodiments the underband 110 has a width in a range of from 0.5 cm to 6 cm, from 0.5 cm to 5 cm, from 0.5 cm to 4 cm, from 0.5 cm to 3.5 cm, from 0.5 cm to 3 cm, from 1 cm to 3 cm, from 0.5 cm to 2.54 cm, from 1 cm to 2.54 cm, or from 0.5 cm to 2 cm. Additional details and information regarding the fabrication of the underband 110 and the fabrics therein will be described in more detail infra.

Figure 13:
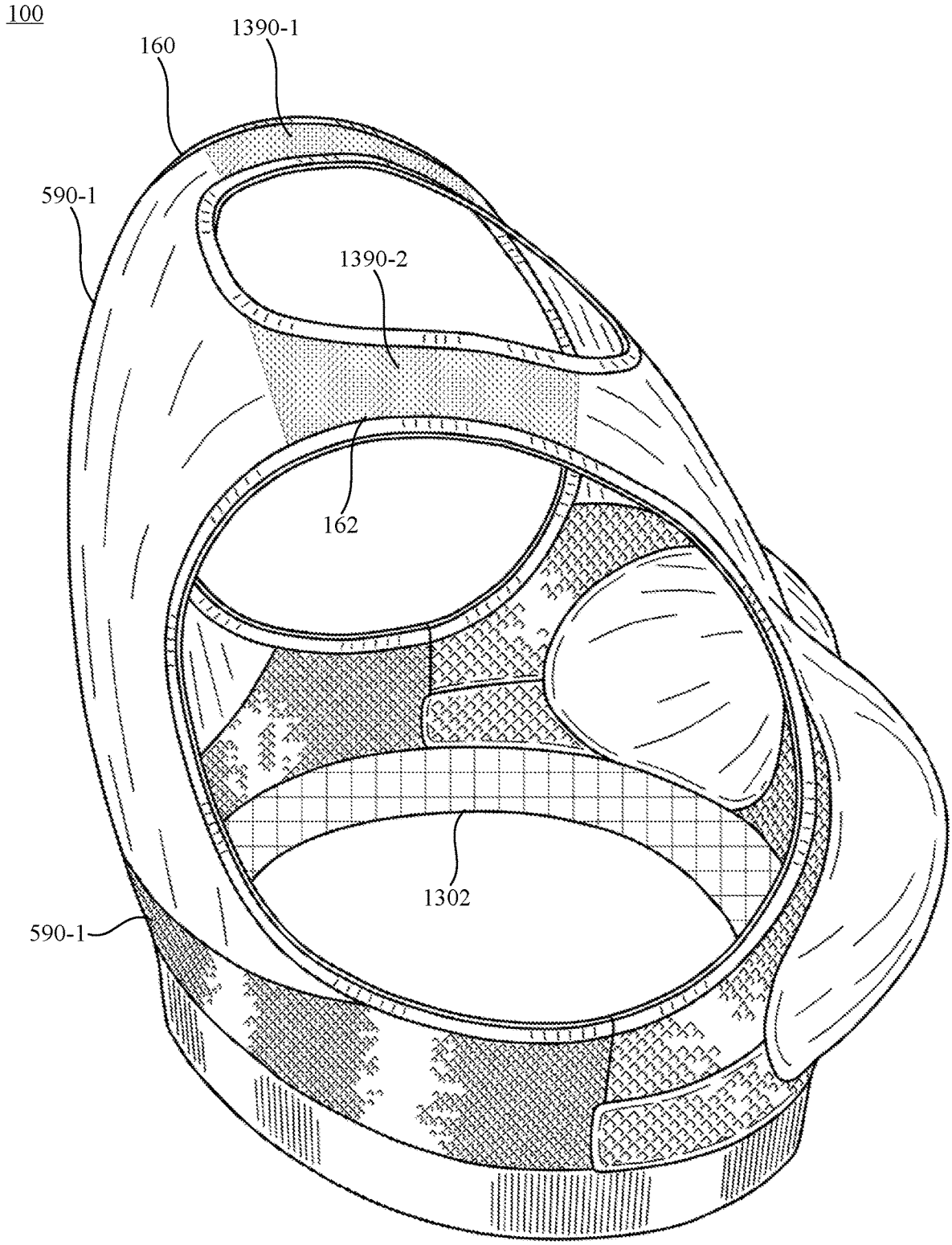
FIG. 13 illustrates a view of even yet another bra in accordance with an embodiment of the present disclosure.

Referring briefly to FIG. 13, in some embodiments, and as illustrated in at least FIG. 13, a textile strip 1302 is attached to a portion of the inner surface of the underband 110. In some embodiments, the textile strip 1302 is formed from a material that is configured to adhere to a surface when the material is exposed to moisture (e.g., becomes damp). For instance, when the textile strip 1302 becomes damp, either due to moisture in and/or on the first textile strip and/or the torso of the wearer, the first text tile strip becomes adhesive and adheres to the torso. This dampening of the textile strip 1301 is repeated such that the textile strip is capable of being dampened and dried a plurality of times without hindering the adhesive properties of the material. This adhesion imparted by the textile strip 1302 ensures that the bra 100 remains in place during activities of perspiration (e.g., sports and stress) without leaving residue on the user or providing discomfort (e.g., chafe or abrade) to the wearer. In some embodiments, the textile strip 1302 includes Stay4Sure (e.g., nano-elastic) silicon coating as provided by Stretchline Holdings 1430 Broadway Suite 307, New York, N.Y. 10018 U.S.A. In some embodiments, the textile strip 1302 is between 0.5 centimeters (cm) and 3 cm wide, between 0.5 cm and 2.5 cm wide, or between 0.25 cm and 2.0 cm wide. In some embodiments, the textile strip 1302 is as wide as the underband 110. In some embodiments, the textile strip 1302 is half as wide as the underband 110. In some embodiments, the textile strip 1302 is a quarter as wide as the underband 110. In some embodiments, the textile strip 1302 is as wide as the bottom portion of the band 102. Moreover, in some embodiments, the textile strip 1302 spans a length that is approximately equal to a length of the underband 110. In some embodiments, the textile strip 1302 spans a length that is approximately equal to three-quarters of the length of the underband 110. In some embodiments, the textile strip 1302 spans a length that is approximately equal to half of the length of the underband 110. In some embodiments, the textile strip 1302 is divided into at least a first portion which spans a first length of the underband 110 and a second portion which spans a second length of the underband. The textile strip 1302 provides extraordinary comfort to the wearer during medium and high impact activities such as sports. For instance, the textile strip 1302 ensures that the bra 100 is stabilized against the torso, while the encapsulation of the breasts by the respective cup regions 104 and 106 enable individual movement of the breasts. Additionally, in some embodiments the textile strip 1302 is disposed on the inner surface of the underband 110 after the band 102 and the underband 110 of the bra 100 have been fabricated (e.g., after the bra is fabricated using a circular knitting machine).

Figure 9:
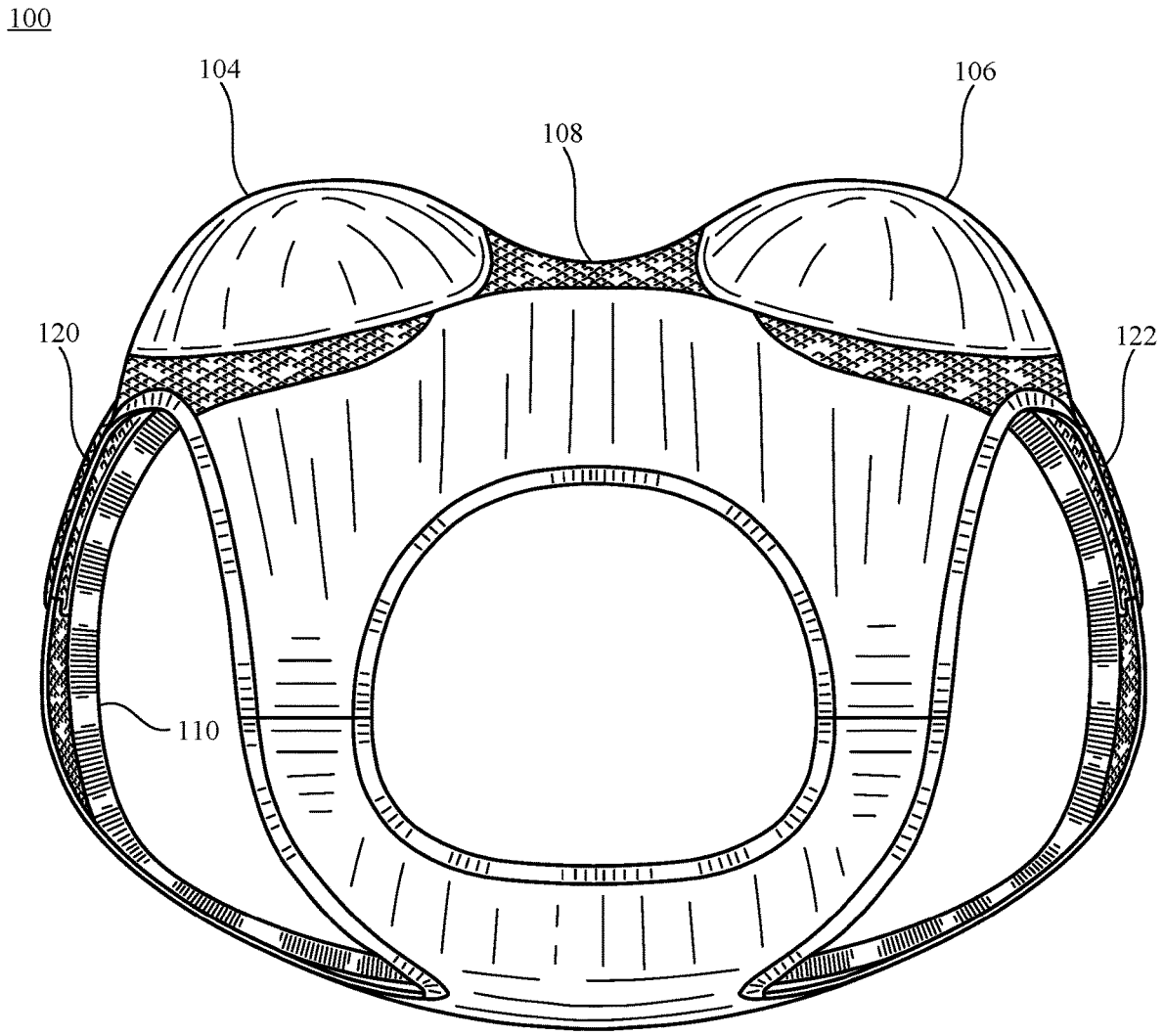
FIG. 9 illustrates a top view of the bra of FIG. 1.
Figure 10:
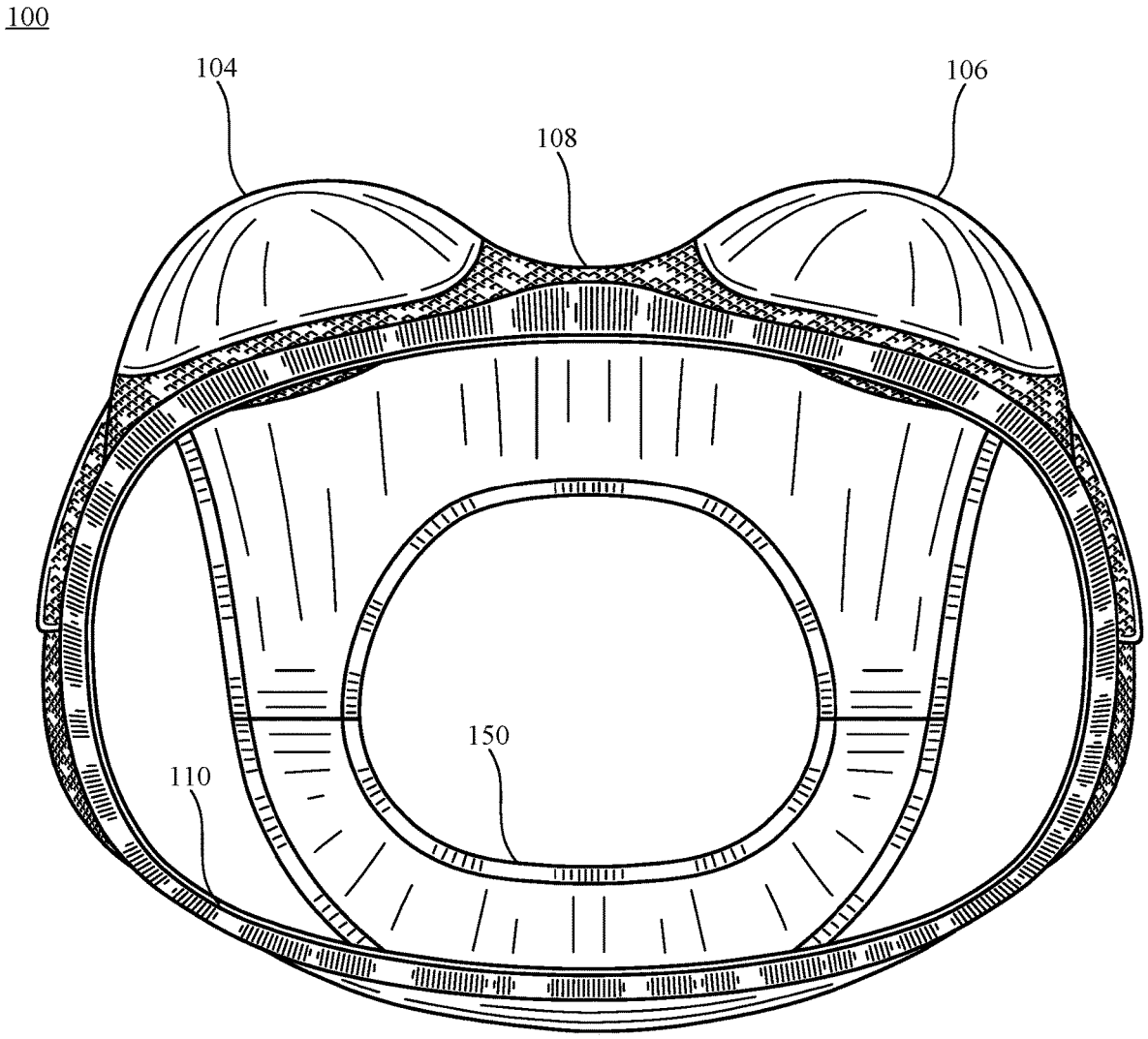
FIG. 10 illustrates a bottom view of the bra of FIG. 1.

Referring back to FIG. 1 through FIG. 3, in various embodiments, the bra 100 includes one or more gussets formed at an outer edge portion of each respective cup region 104 and 160 and proximate to the respective underarm portion of the band 102. For instance, in some embodiments the bra 100 includes a first gusset 120 formed at an outer edge portion of the first cup region 104 proximate to the first underarm portion of the band 102 and a second gusset 122 formed at an outer edge portion of the second cup region 106 proximate to the second underarm portion of the band. As illustrated in FIG. 2, in some embodiments the first gusset 120 and/or the second gusset 122 has a length that spans from the outer edge portion of the respective cup region 104 or 106 to a portion of the back portion of the band 102. Referring briefly to FIG. 9, in some embodiments the first gusset 120 and/or the second 122 is formed to protrude outwardly from the bra 100. For instance, in some embodiments the first gusset 120 and/or the second gusset 122 protrude outwardly from the front of the band 102 by a distance in a range of from 0.1 mm to 10 mm, by a distance in a range of from 0.1 mm to 5 mm, by a distance in a range of from 0.1 mm to 2 mm, or by a distance in a range of from 0.5 mm to 5 mm.

A gusset (e.g., first gusset 120, second gusset 122, etc.), as used herein, is a component of the bra 100 that is intentionally weakened to relieve stress formed in areas surrounding the respective gusset. Each gusset allows for slight breast movement to give the wearer a natural feeling while wearing the bra 100, but also prevents the bra from moving as a whole unit when the wearer is active. In some embodiments, the intentional weakening is provided by utilizing materials with different Young's moduli. The Young's modulus is utilized to measure a stiffness of a solid, or approximately solid, material as determined by an experienced stress and strain through a uniaxial deformation of the material. A smaller Young's modulus (e.g., a number closer to zero) describes a material with a low stiffness (e.g., a high extensibility such as small strain rubber which has a Young's modulus of approximately 0.01 to 0.1 Giga-Pascal's (GPa)), while a larger Young's modulus (e.g., a number further from zero) describes a material with a high stiffness (e.g., a low extensibility such as diamond which has a Young's modulus of approximately 1050 to 1210 GPa). For instance, low-density polyethylene has a Young's modulus of approximately 0.11 to 0.86 GPa, nylon has a Young's modulus of approximately 2 to 4 GPa, foam polystyrene has a Young's modulus of approximately 0.0025 to 0.007 GPa, hemp fiber has a Young's modulus of approximately 35 GPa, polyethylene terephthalate (PET) has a Young's modulus of approximately 2 to 2.7 GPa, and polypropylene has a Young's modulus of approximately 1.5 to 2 GPa, to name a few. In some embodiments, a respective gusset (e.g., the first gusset 120, the second gusset 122, etc.) has a Young's modulus that is lower than a surrounding fabric (e.g., the fabric of the underband 110, the respective cup region 104 or 106, or the band 102). In some embodiments, the respective gusset has a Young's modulus that is greater than a surrounding fabric (e.g., the fabric of the underband 110, the respective cup region 104 or 106, or the band 102). However, the present disclosure is not limited thereto.

Furthermore, in various embodiments a high modulus fiber is a fiber with a Young's modulus greater than or equal to 0.5 GPa, greater than or equal to 0.6 GPa, greater than or equal to 0.7 GPa, greater than or equal to 0.8 GPa, greater than or equal to 0.9 GPa, greater than or equal to 1.0 GPa, greater than or equal to 1.1 GPa, greater than or equal to 1.2 GPa, greater than or equal to 1.3 GPa, greater than or equal to 1.4 GPa, greater than or equal to 1.5 GPa, greater than or equal to 2 GPa, or greater than or equal to 2.5 GPa, greater than or equal to 5 GPa. As a non-limiting example, a fiber that includes a polyethylene monofilament having a tensile strength of approximately 0.197 GPa displays a Young's modulus of approximately 2.34 GPa.

In some embodiments, the intentional weakening in the respective gusset is provided by a process of inducing a stress at a predetermined portion of the bra 100. In some embodiments, the stress is a physical stress such as a tensile stress, a compressive stress, a shear stress, or a combination thereof. In some embodiments, the stress is a material stress such as a predetermined deterioration (e.g., wearing away or abrasion) of the material of the bra 100. In some embodiments, the intentional weakening is provided by a process of subjecting a portion of the bra 100 to a heat treatment process of a chemical treatment process.

Figure 5:
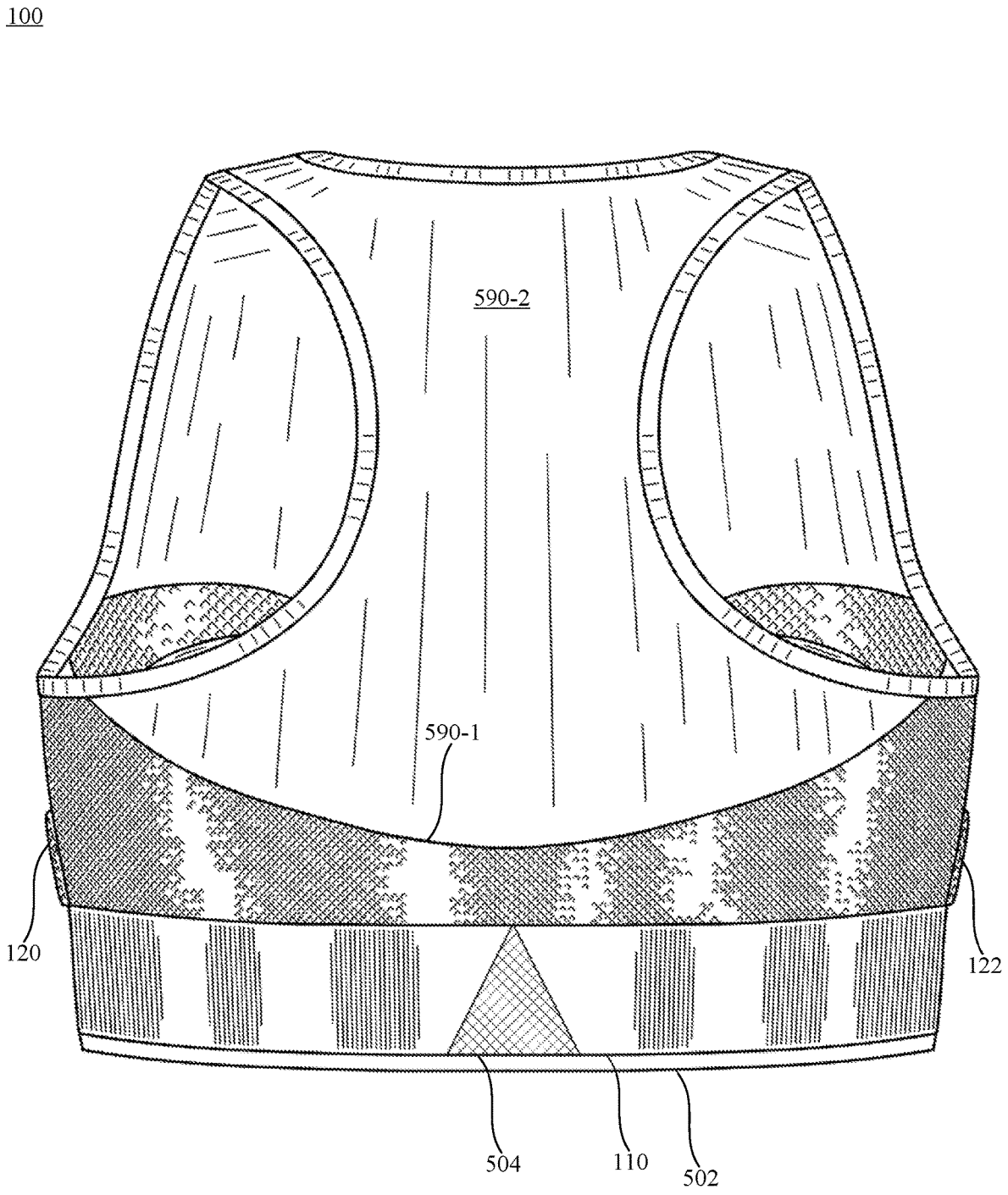
FIG. 5 illustrates a back view of a further bra in accordance with an embodiment of the present disclosure.
Figure 6:
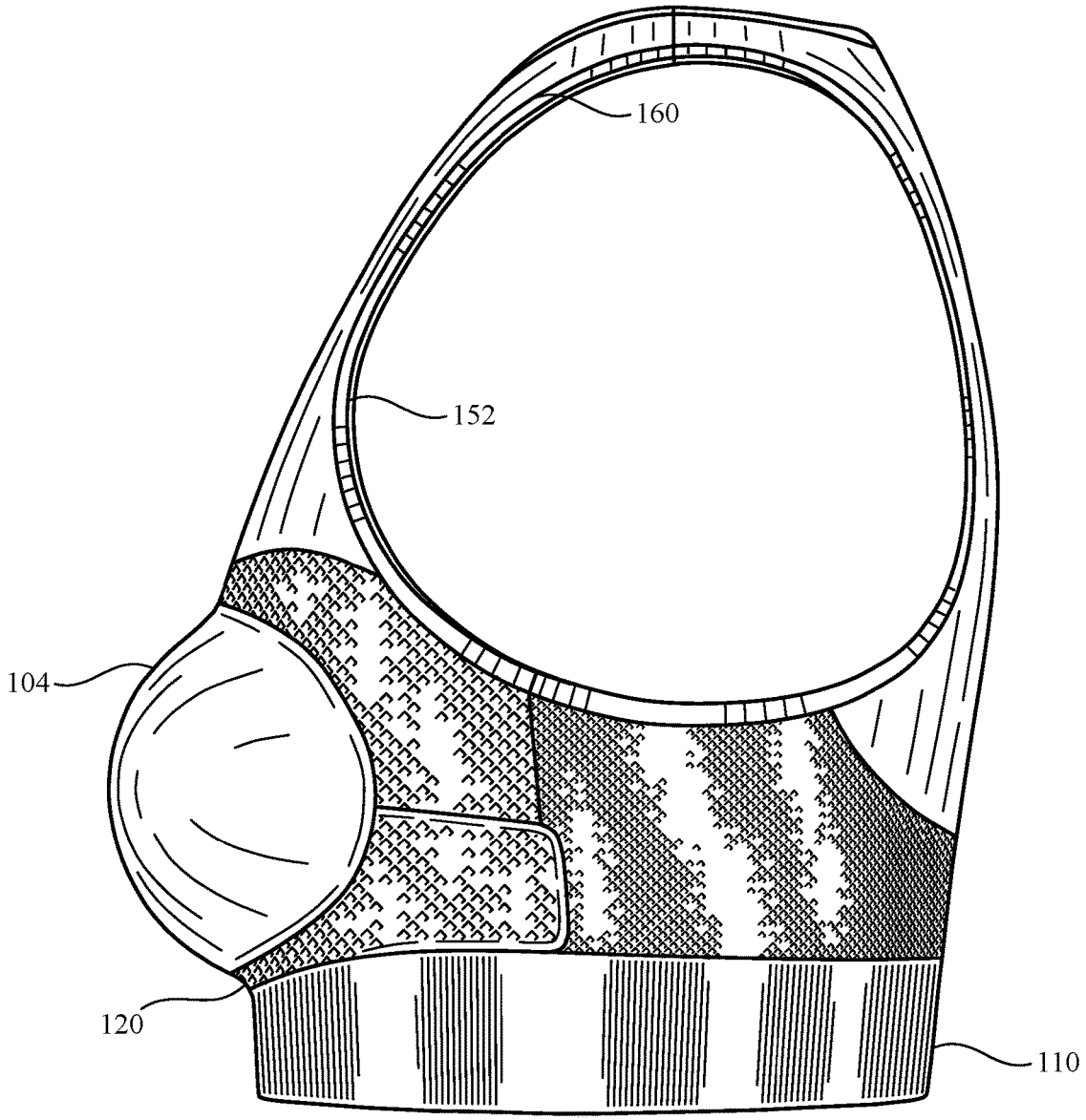
FIG. 6 illustrates a first side view of the bra of FIG. 1.
Figure 7:
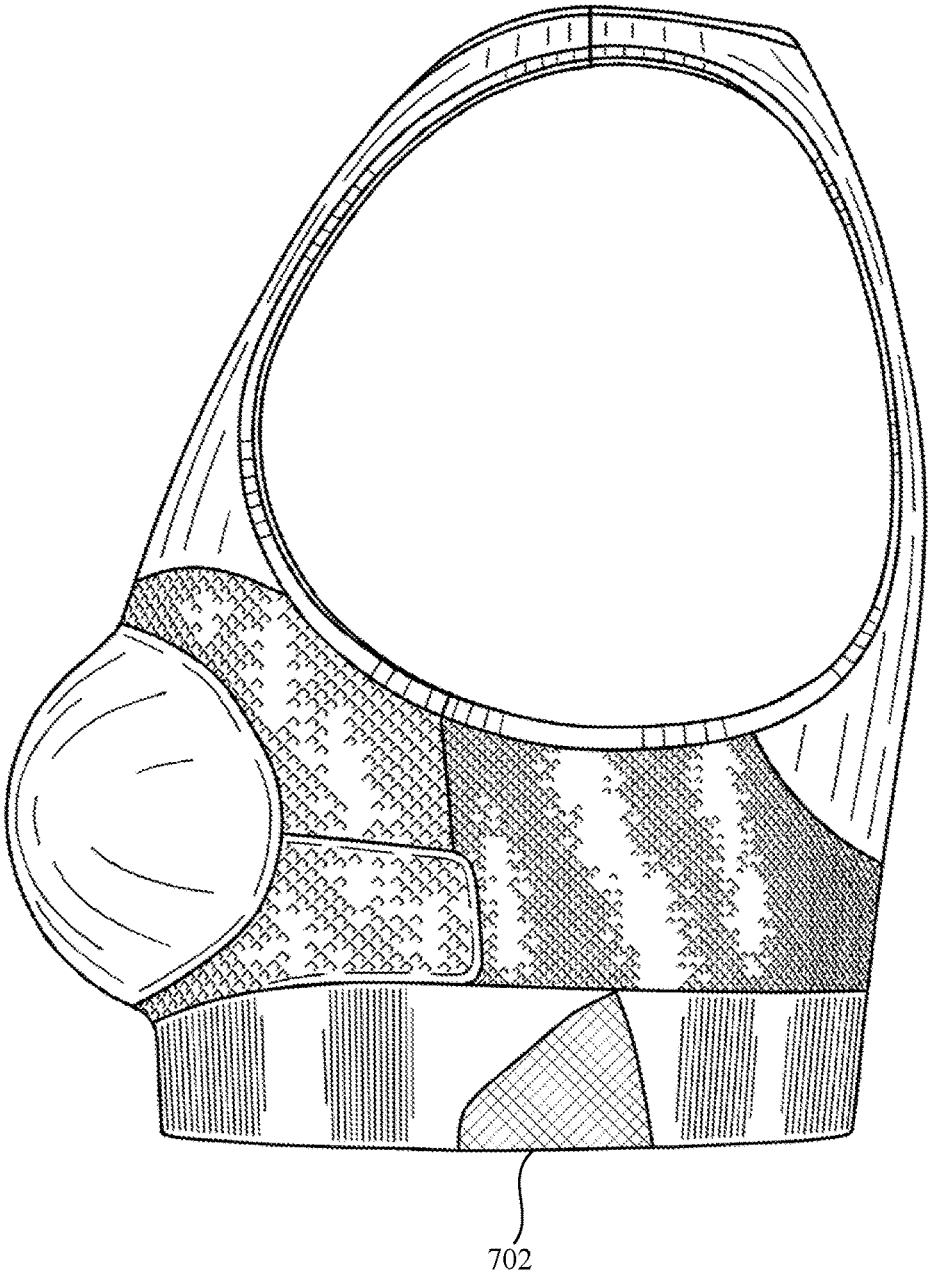
FIG. 7 illustrates a first side view of yet another bra in accordance with an embodiment of the present disclosure.
Figure 8:
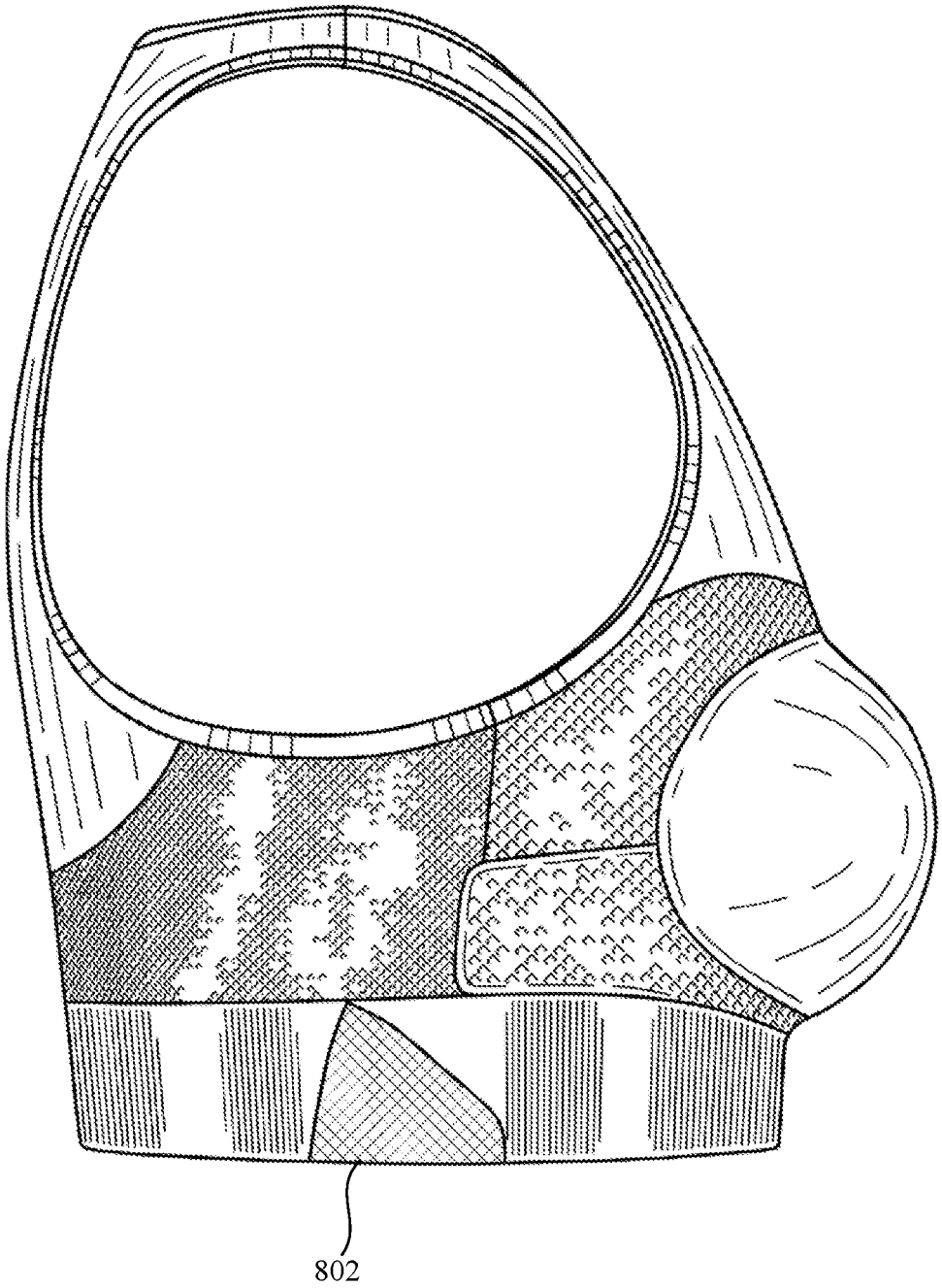
FIG. 8 illustrates a second side view of the bra of FIG. 7.

Referring to briefly to FIG. 5, FIG. 7 and FIG. 8, in various embodiments, the bottom portion of the underband 110 includes one or more gussets (e.g., a third gusset 702, a fourth gusset 802, fifth gusset 504, etc.). In some embodiments, the gusset is formed in a portion of the underband 110 that is below the back portion of the band 102 (e.g., the fifth gusset 504 of FIG. 5). Likewise, in some embodiments, the gusset is formed in a portion of the back portion of the band 102. Additionally, in some embodiments the gusset is formed in a portion of the underband 110 that is below either underarm portion of the band 102. For instance, in some embodiments a third gusset 702 (FIG. 7) is formed in a portion of the underband 110 that is below the first underarm portion proximate to the first cup region 104. In some embodiments, a fourth gusset 802 (FIG. 8) is formed in a portion of the underband 110 that is below the second underarm portion proximate to the second cup region 106. Accordingly, in some embodiments a respective gusset 702 and 802 is formed in the portion of the underband 110 that is below each underarm portion of the band 102. Furthermore, in some embodiments an auxiliary gusset (e.g., a sixth gusset 320 of FIG. 3) is formed adjoining the underband 110 to the back portion, the first underarm portion, the second underarm portion, and front portion of the bra 100 (e.g., the sixth gusset 320 spans a circumference of the bra and interposes the underband 110 and the back portion, the first underarm portion, the second underarm portion, and front portion of the bra).

In some embodiments, the underband 110 is formed of a first elastic blend, that has a first percent extensibility (e.g., 10 percent extensibility) when placed under a first strain (e.g., a longitudinal strain, latitudinal strain, or a combination thereof), and the gusset 702 and/or 802 is formed of a second elastic blend that has a second percent extensibility (e.g., 20 percent extensibility) when placed under the first strain. The extensibility of a material refers to a measure of an ability of a fabric to stretched, or elongated, under a tensile load. The larger the extensibility of a fabric, the more extensible the fabric is. Additional information regarding material engineering and extensibility is found in Zupin et al., 2010, "Mechanical Properties of Fabrics Made from Cotton and Biodegradable Yarns Bamboo, SPF, PLA in Weft," Woven Fabric Engineering, Print, which is hereby incorporated by reference in its entirety. The second percent extensibility is greater than the first percent extensibility, which allows for the gusset 702 and/or 802 to deform according to a fit of the wearer. For instance, in various embodiments, such as the pull-on bra 100, the one or more gussets (e.g., first gusset 120, second gusset 122, third gusset 702, fourth gusset 802, etc.) elastically deforms to stretch and expand a circumference of the band 102 and/or the underband 110, allowing the wearer to put on the bra 100 without discomfort. In some embodiments, the second percent extensibility is ten percent greater than the first percent extensibility, fifteen percent greater than the first percent extensibility, twenty percent greater than the first percent extensibility, twenty-five percent greater than the first percent extensibility, thirty percent greater than the first percent extensibility, thirty-five percent greater than the first percent extensibility, forty percent greater than the first percent extensibility, forty-five percent greater than the first percent extensibility, fifty percent greater than the first percent extensibility, fifty-five percent greater than the first percent extensibility, sixty percent greater than the first percent extensibility, or sixty-five percent greater than the first percent extensibility. Moreover, in some embodiments the first blend of the underband 110 is the same as the second blend of the respective gusset.

In various embodiments, the underband 110 has a first width that is perpendicular to a length of a first elastic blend of the underband 110. Accordingly, in various embodiments the respective gusset 702 and/or 802 has a variable width that runs along the length of the first elastic blend of the underband 110. In some embodiments, the respective gusset 702 and/or 802 has a variable width that tapers between a first width and a second width. In some embodiments, the respective gusset 702 and/or 802 has a width that is greater than a centimeter at the first width and a width that is less than a centimeter at the second width. In some embodiments, the respective gusset 702 and/or 802 has a width that is greater than 1.3 centimeters at the first width and a width that is less than 0.3 centimeters at the second width. In some embodiments, the respective gusset 702 and/or 802 is formed in an approximately triangular shape as illustrated in FIG. 7 and FIG. 8. However, the present disclosure is not limited thereto. For instance, in some embodiments, the respective gusset 702 and/or 802 is formed in an approximately quadrilateral shape. Generally, a designer of the present disclosure configures a shape and/or a material of the respective gusset 120, 122, 702, and/or 802 in order to impart various extensibility characteristics of the respective portions of the bra 100 proximate to the respective gusset.

Referring to back to FIG. 1 through FIG. 3, in various embodiments the bra 100 includes one or more straps (e.g., shoulder straps) that are included in the band 102. For instance, in some embodiments a first strap 160 is connected to a first position of the band 102 proximate to the back portion and is also connected to a second portion of the band proximate to the front portion. In some embodiments, a second strap 162 is connected to a third position of the band 102 proximate to the back portion and is also connected to a fourth portion of the band proximate to the front portion. Accordingly, each respective strap 160 and 162 adjoins a respective cup region 104 or 106 to a respective portion of the back portion of the band 102. In various embodiments, each respective strap 160 and/or 162 corresponds to an arm portion of the wearer, and in some embodiments provides support for the breasts of the wearer. However, in other embodiments the strap 160 and/or 162 of the bra 100 is largely ornamental and provides no significant support for the breasts of the wearer. In some embodiments, each arm portion of the wearer (e.g., each underarm portion of the band 102) includes a respective strap (e.g., the first underarm portion includes the first strap 160, the second underarm portion includes the second strap 162, etc.). In other embodiments, only one underarm portion of the band 102 includes a respective strap (e.g., the bra is a one strap or sling type bra). While the figures of the present disclosure illustrate should straps that do not cross over each other, the present disclosure is not limited thereto. For instance, in some embodiments the straps 160 and 162 cross at the back portion of the band 102 (e.g., form an X-shape) such as that of a Racerback type bra strap. In some embodiments, the straps 160 and 162 cross at the front portion of the band 102. In some embodiments, the first strap 160 and the second 162 combine to form a single strap that couples a first portion of the front portion of the band 102 to a second portion of the front portion of the band (e.g., the first strap 160 and the second strap 162 combine to form a halter type bra strap).

In some embodiments, and as illustrated in FIG. 1 through FIG. 10, a bra 100 of the present disclosure includes one or more reinforcements that is formed about a periphery of the bra. For instance, in some embodiments the bra 100 includes a first reinforcement 150 that surrounds a periphery of the neckline portion of the bra. In some embodiments, the bra 100 includes a respective reinforcement (e.g., a second reinforcement portion 152 and/or a third reinforcement portion 154) that surround a periphery of a corresponding underarm portion of the band 102. For instance, in some embodiments the bra 100 includes the second reinforcement 152 that spans a first portion of the first strap 160 and the first underarm portion of the band 120, and a third reinforcement portion 154 that spans a first portion of the second strap 162 and the second underarm portion. Furthermore, referring briefly to FIG. 5, in some embodiments the bra 100 includes a fourth reinforcement 502 that spans an outer circumference, or at least a portion of the outer circumference, of the underband 110. In some embodiments, one or more of the reinforcement portions 150, 152, 154, and/or 502 of the bra 100 is formed as a hem. However, the present disclosure is not limited thereto. For instance, in some embodiments the one or more of the reinforcement portions 152, 154, and/or 502 of the bra 100 is formed as a band of fabric that surrounds the periphery of the corresponding portion of the bra. Furthermore, in some embodiments the one or more of the reinforcement portions 152, 154, and/or 502 of the bra 100 includes an elastic material (e.g., the reinforcement portion includes an elastic trim). Accordingly, each reinforcement portion provides a finishing to the respective portion of the bra 100 that prevents unraveling of the bra and/or reinforces the respective portion to increase a durability of the bra.

Nevertheless, in some embodiments, one or more of the reinforcement portions 150, 152, 154, and/or 502 has a width in a range of from 0.1 cm to 4 cm, a width in a range of from 0.1 cm to 2.54 cm, a width in a range of from 0.5 cm to 2.54 cm, a width in a range of from 0.1 cm to 2 cm, a width in a range of from 0.1 cm to 1.5 cm, a width in a range of from 0.5 cm to 1.5 cm, a width in a range of from 0.1 cm to 0.5 cm, or a width in a range of from 0.635 cm (e.g., a quarter inch) to 1.27 cm (e.g., a half inch). In various embodiments, if one or more of the reinforcement portions 150, 152, 154, and/or 502 are required to form the bra 100, the reinforcement portions and the adjacent portions of the bra are configured such that failure of the bra 100 occurs at the adjacent portions instead of the reinforcement portions to ensure a high quality bra with improved durability.

Figure 16:
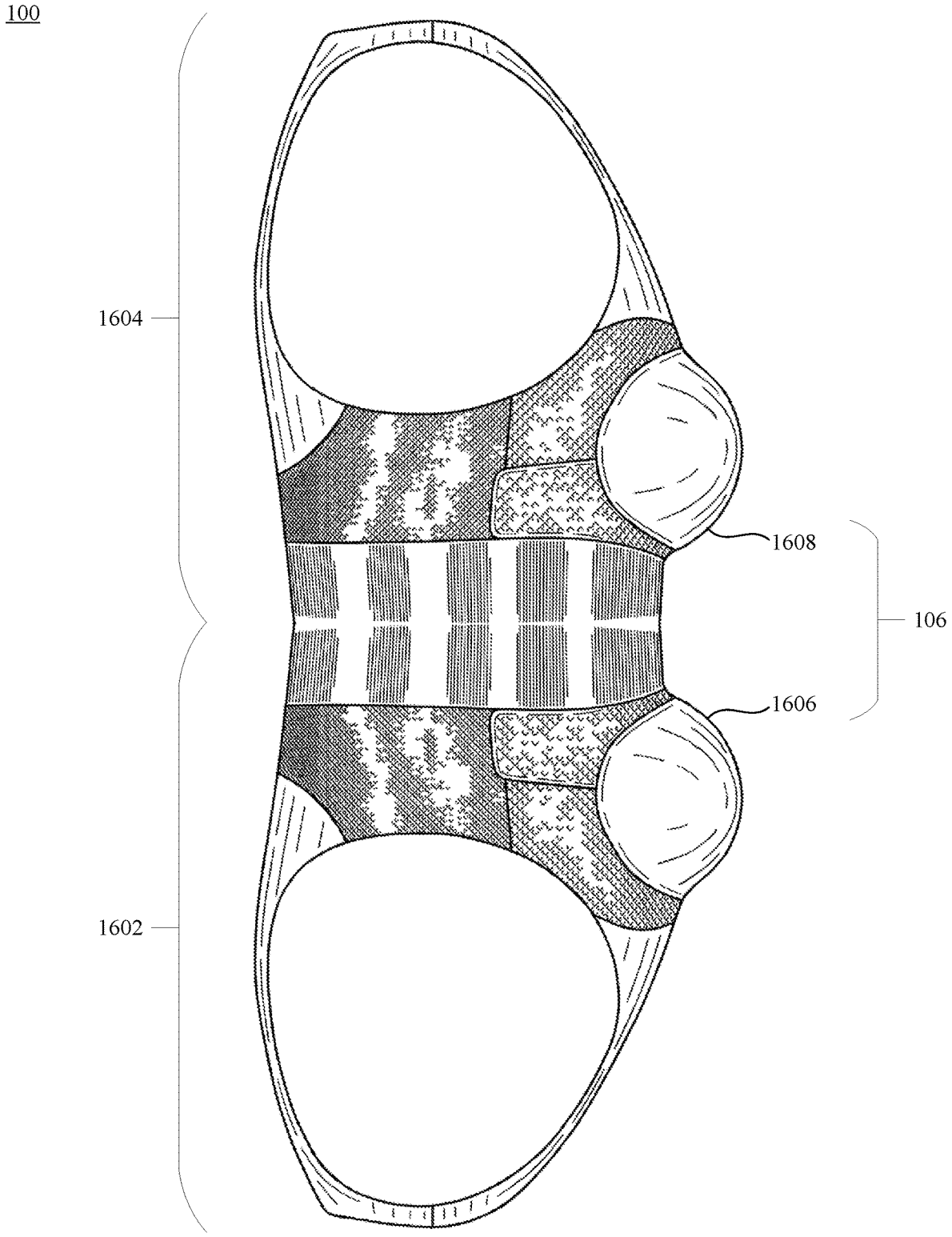
FIG. 16 illustrates a double layer fabrication of a bra in accordance with an embodiment of the present disclosure.

In various embodiments, a cradle 402 (e.g., the molded cradle 402 of FIG. 4) is fitted between an inner layer and an external layer of the bra 100 (e.g., internal layer 1602 and external layer 1604 of FIG. 16). The cradle 402 assists in positioning the gore 108 as well as the first cup region 104 and the second cup region 106 to the chest of the wearer. Likewise, in other embodiments the cradle 402 is fitted between an inner layer and an external layer of the bra 100 by bonding the cradle to the either or both of the internal layer and the external layer. In some embodiments, the cradle 402 is a wire. To allow the bra 100 to rest comfortably against the wearer, the cradle 402 is formed with at least a first curvature in a first plane. In some embodiments, the cradle 402 is also formed with a second curvature in a second plane, which is orthogonal to the first plane of the first curvature. These curvatures are designed to match various contours of the wearer of the bra, such as a contour of the torso and a contour of each breast region.

In order for the cradle 402 to rest comfortably against the wearer, the cradle is formed of a flexible material. Moreover, in some embodiments the cradle 402 is formed via an additive manufacturing process in some embodiments. For instance, in some embodiments, the cradle 402 is formed via injection molding. In other embodiments, the cradle 402 is formed via a three-dimensional printing process such as fused deposition modeling (FDM), stereolithographic (SLA), or selective laser sintering (SLS). Materials used to form the cradle 402 in various embodiments of the present disclosure include thermoplastic elastomers (TPE) such as thermoplastic rubbers and resins, a variety of foams such as auxetic foam or polyurethane foam, a variety of plastics (e.g., polylactic acid (PLA) and polyvinyl alcohol plastic (PVA)), as well as silicon. For instance, thermoplastic elastomers and resins include a styrenic block copolymer, a thermoplastic polyolefinelastomer, a thermoplastic vulcanizate, a thermoplastic polyurethane, a thermoplastic copolyester, or a thermoplastic polyamide. These materials and other materials that form various components and portions of the bra 100 will be described in more detail infra.

While some embodiments of the bras 100 of the present disclosure include the cradle 402, an additional aspect of the present disclosure is directed to providing seamless bras that do not require the cradle. Through the use of varying stitches (e.g., knits) of fabrics and low melt yarn, the bras of the present disclosure provide a medium to high level or support to the breasts of the wearer without requiring the cradle 402. Particularly, including low melt yarn in a portion of the straps 160 and 162 (e.g., portions 1390-1 and 1390-2) as well as the cup regions 104 and 106 forms an equilibrium of support for the breasts such that movement of the breasts is damped omnidirectional.

Figure 11:
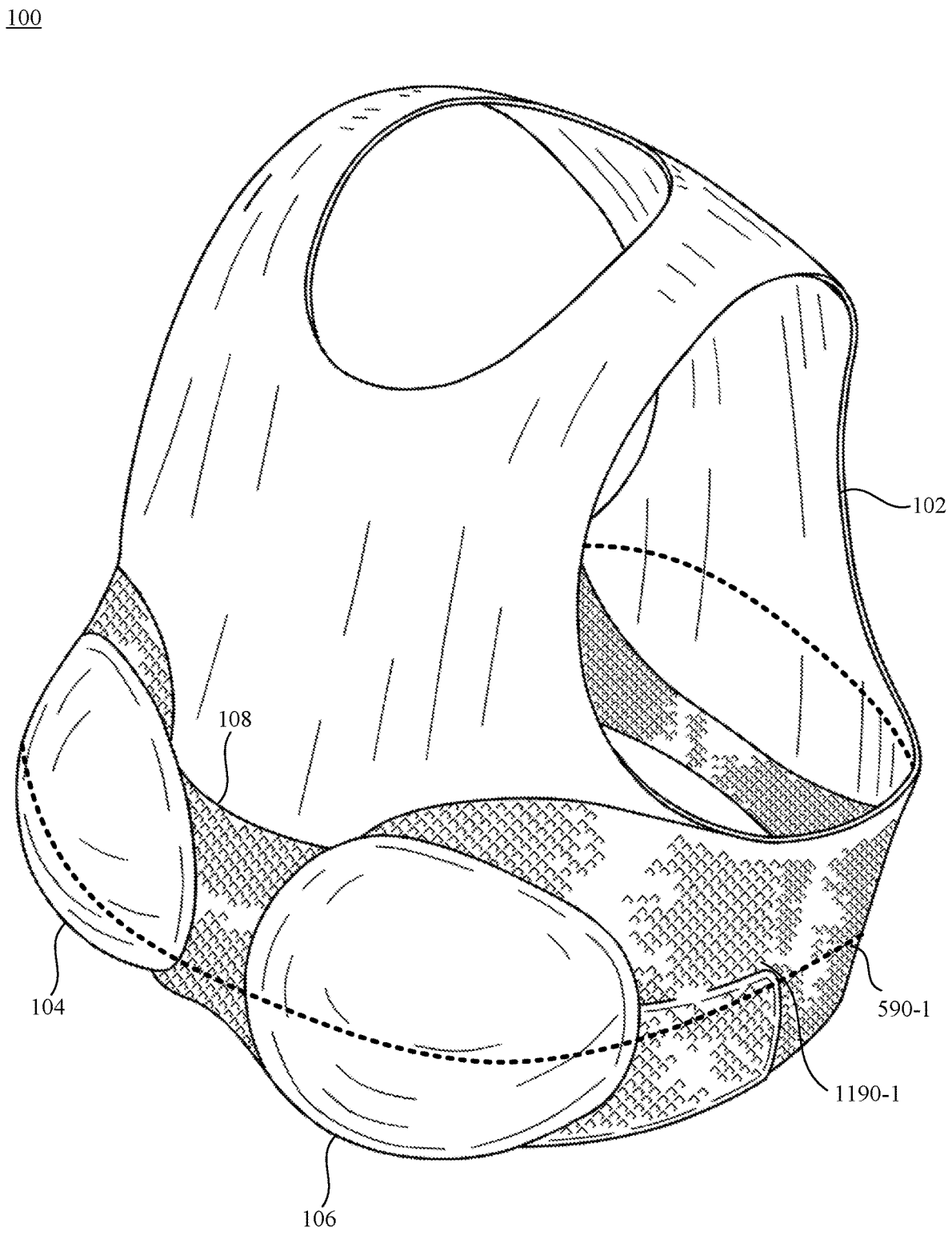
FIG. 11 illustrates a view of a yet further bra in accordance with an embodiment of the present disclosure.
Figure 12:
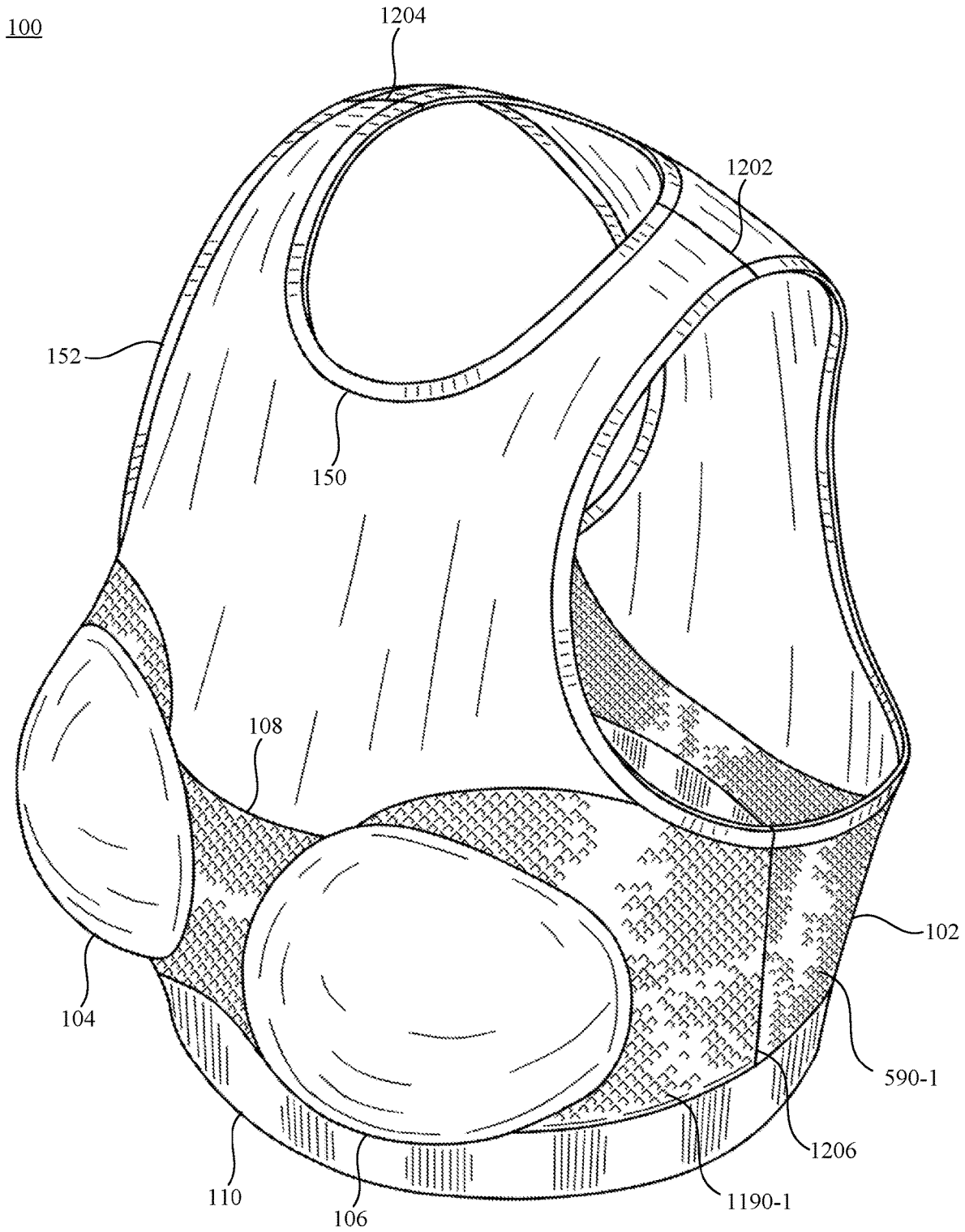
FIG. 12 illustrates a view of yet another bra in accordance with an embodiment of the present disclosure.

Additionally, while an aspect of the present disclosure is directed to providing seamless pullover bras, a designer of the present disclosure reinforces various portions of the bra 100 to prevent the bra from deteriorating over time. Referring, briefly to FIG. 12, in some embodiments an upper end portion of the bra 100 includes a stitched seam to reinforce an ability of the bra to support a vertical load. For instance, in some embodiments an upper end portion of a respective strap 160 and/or 162 of the bra 100 includes a seam 1202 and/or 1204, respectively, that provides additional support and durability to the bra. Furthermore, in some embodiments a respective underarm portion of the bra 100 includes a seam 1206, that also provides additional support and durability to the bra. These seams 1202, 1204, and/or 1206 are disposed at portions of the bra 100 that are susceptible to degradation from everyday wear and tear of the bra. However, as previously described, the present disclosure is not limited thereto. For instance, as illustrated in FIG. 11, in some embodiments the bra 100 is formed as a seamless bra without any reinforcements (e.g., hems 150, 152, and/or 154; and/or seams 1202, 1204, and/or 1206).

Now that a general structures of various embodiments of the bras 100 of the present disclosure have been described, various fabrication techniques and materials of the bras will now be described in detail.

In some embodiments, the bras 100 of the present disclosure are formed (e.g., manufactured, fabricated, etc.) using a circular knitting machine, thus fabricating each respective bra in a continuous uninterrupted process. This continuous process allows for the bra 100 to be fabricated seamlessly, such that various respective portions of the bra are connected to one another without a sewn seam between the portions. Additionally, the circular knitting machine enables a designer of the present disclosure to seamlessly knit together different fabrics at various portions of the bras 100. Further, circular knitting machines enable the bras 100 to be fabricated with minimal or no required cutting of the fabrics of the bras as well as a minimal seam joining (e.g., omits a seam joining, thus providing a seamless bra). Additionally, the continuous fabrication of the circular knitting machine provides increased structural load bearing capacities for the bras 100, since the seams of a garment typically fail due to fabric breakage or tearing when a stress is applied. See Kordoghli et al., 2009, "Mechanical Behavior of Seams on Treated Fabrics," AUTEX Research Journal, 9(3), pg. 87, which is hereby incorporated by reference in its entirety. Furthermore, due to the continuous process of the circular knitting machines, fabrication of a respective bra begins at a first end portion of the bra and is built up in a plurality of layers to complete at a second end portion of the bra. Since the bras 100 of the present disclosure have an approximately tubular, or cylindrical, shape, circular knitting machines are preferable.

The circular knitting machines of the present disclosure include single knit circular knitting machines as well as double knit circular knitting machines. Generally, without accounting for a type of fabric and stitching, a single knit machine provides a looser fitting, or more extensible, bra 100, whereas a double knit machine provides a more rigid, or taught, bra. The rigidity of the bra 100, and respective portions of the bra, is proportional to a type of stitching utilized and a type material utilized (e.g., a thickness of the material).

In some embodiments, the circular knitting machine provides a run resistant stitch, a tuck stitch, a ribbed stitch, a double knit, a float stitch, and other similar stitches known to one skilled in the art. However, the present disclosure is not limited thereto. Moreover, in circular knitting machines, the yarn count primarily depends on a pitch of a respective needle, and, thus, the machine gauge. As a diameter of a yarn is proportional to its yarn count, a relationship exists between the range of optimum counts of yarn that is knitted on a particular machine, and the gauge of the machine. Nevertheless, in some embodiments the bra 100 of the present disclosure is fabricated using a circular knitting machine as provided by SANTONI SPA—Via Carlo Fenzi, 14-25135 Brescia—Italy, hereinafter "Santoni." In some embodiments, the bra 100 is fabricated using the SM4-TL2 Single Jersey circular knitting machine as provided by Santoni.

In using the circular knitting machines, a plurality of fabrics is accommodated about a circular knitting machine, with a free end portion of each fabric in the plurality of fabrics being accommodated by a feeder. As previously described, in some embodiments the fabrics utilized in fabricating the bras 100 of the present disclosure include low melt yarns, cottons, silks, wools, polyesters, nylon, and the like. A plurality of needles is arranged in a circular array about the circular knitting. The plurality of needles is sized according to a gauge of the needles. The gauge (GG) of the plurality of needles refers to the number of needles disposed in an inch width of a machine needle bed (e.g., at 15 GG there exists 15 needles per inch of needle bed). Thus, in some embodiments of the present disclosure the circular knitting machine utilizes a gauge of the plurality of needles in a range of from 48 GG to 80 GG.

Nevertheless, for each needle in the plurality of needles, a sinker is disposed adjacent to the respective needle. Each sinker includes a butt that accommodates a cam, a hold that prevents movement of a respective fiber in a vertical direction, a throat that receives a respective fabric, and a nose that accommodates a relaxed, or resting fabric. In operation, a respective needle has a loop of a knit of a first fabric (e.g., a knit of polyester) disposed about its circumference. The needle raises to receive a portion of a second fabric of a respective feeder (e.g., catch a portion of a low melt yarn fabric) via a hook disposed at an end portion of the needle. Synchronous with the raising of the needle, the sinker traverses orthogonally to the needle to receive the loop of the knit of the first fabric at the throat of the sinker, which also prevents the loop from moving vertically via the hold of the sinker. Further, since loop of the knit of the first fabric is held in place by the throat and the hold of the sinker, a catch on the needle traverse through the loop of the knit and assists receiving the portion of the second fabric in combination with the hook. When the needle descends, the sinker traverses to return to its original position, such that the portion of the second fabric is feed through the loop of the knit of the first fabric. Accordingly, knock over, cast over, and/or stitch forming occurs. Thus, the circular knitting machine is capable of seamlessly transition from a first blend of fabrics to a second blend of fabrics. For instance, the circular knitting machine can seamlessly transition from pique stitch of a first fabric to a mesh stitch of a second fabric.

As briefly described above, circular knitting machines enable a designer of the present disclosure to vary different portions and regions of the bra 100 by using different densities and patterns of fabric. Generally, higher density knits are less susceptible to penetrations (e.g., punctures) and decreased breathability, which provides an improved resistance to punctures, impacts, tears, and abrasion. For instance, the placement of different patterns of fabrics is optimizable through variations in the denier of the yarns (e.g., fabrics) and yarn counts along a given direction. As used herein, Denier (D) is a mass per unit length measure expressed as a mass in grams of a 9,000 meter (m) length of yarn or fiber. Further, as used herein, dtex is a mass per unit length measure expressed as a mass in grams of a 10,000 meter (m) length of yarn or fiber.

Figure 17:
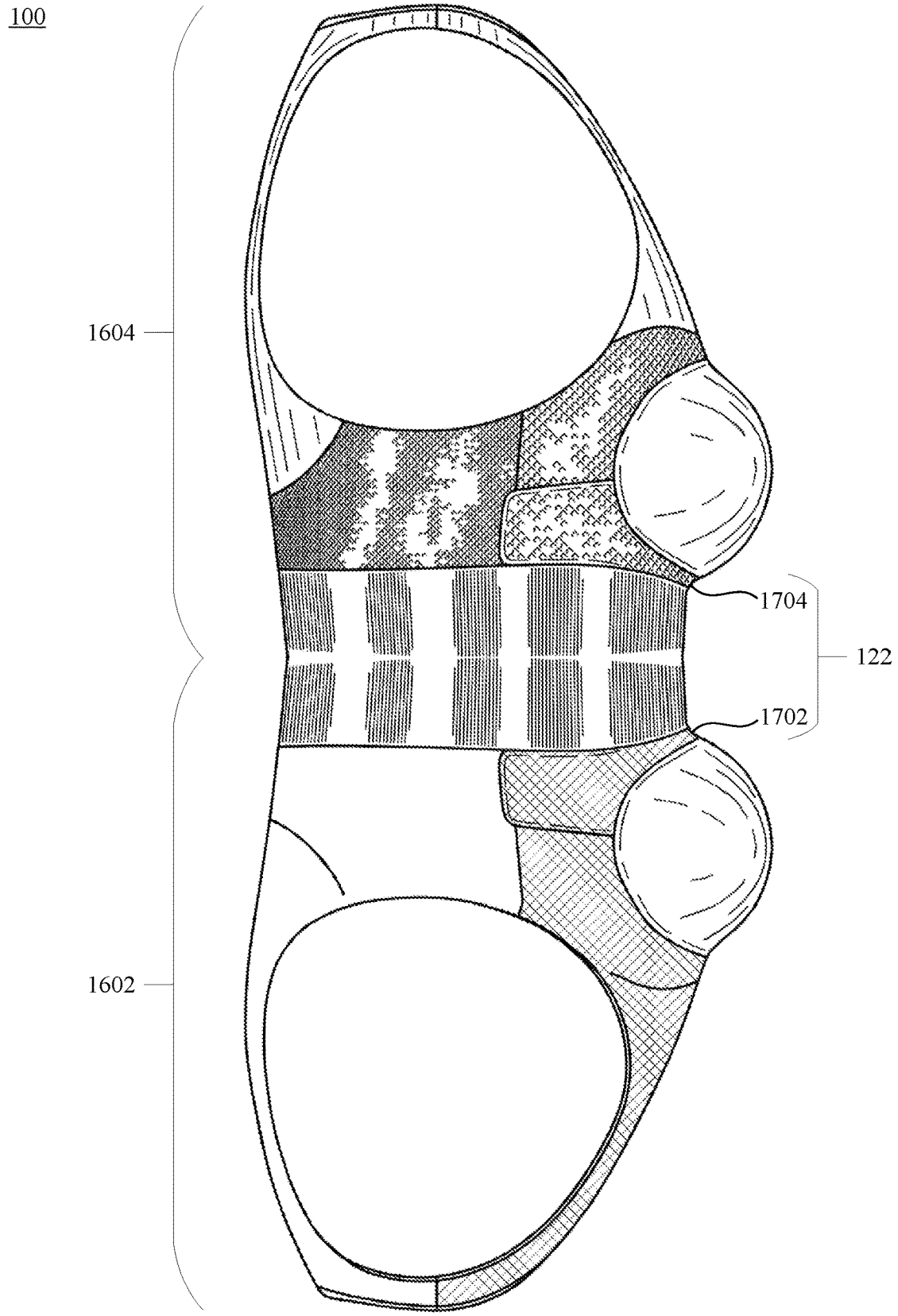
FIG. 17 illustrates a double layer fabrication of yet another bra in accordance with an embodiment of the present disclosure.

Referring briefly to FIG. 16 and FIG. 17, in various embodiments the bras 100 of the present disclosure are fabricated in double layers, such that an internal layer 1602 of the bra 100 and an external layer 1604 of the bra are fabricated integrally. Since, in some embodiments, the bras 100 of the present disclosure are fabricated using a circular knitting machine, the bras are built up on a layer by layer basis. Thus, fabrication of a respective bra begins at an end portion of a first layer (e.g., an end portion of the internal layer 1602) and ends at an end portion of a second layer (e.g., an end portion of the external layer 1604). Double layer fabrication of the bra 100 allows for various patterns of fabrics and various types of fabrics to be utilized for each respective portion of the bra. For instance, in some embodiments, a first pattern of fabric is utilized for an internal portion of the bra 100 and a second pattern of fabric is utilized for an external portion of the bra. Furthermore, in some embodiments one or more additional components of the bra 100 is inserted between the internal layer 1602 and the external layer 1604 of the bra prior to coupling the internal layer and the external layer together. For instance, in some embodiments a pad layer is disposed interposing between an internal portion of a respective cup region (e.g., an internal portion 1606 of the second cup region 106) and an external portion of the respective cup region (e.g., an external portion 1608 of the second cup region 106). Accordingly, the pad layer is affixed between the internal portion and the external portion of the respective cup region through a heat application process. However, the present disclosure is not limited thereto. In other embodiments, the bra 100 is fabricated as a single layer garment.

Fabrics and/or fibers of the present disclosure are selected to provide improved structural performance such as an improved rigidity, and improved extensibility, an improved durability, etc. This improved structural performance of the bra 100 allows for the bra to have a high strength, a low elongation, resistance to fatigue, resistance to flex-fold, improved cyclic loading, resistance to creep, or a combination thereof. Additionally, the improved structural performance of the bra 100 allows for the bra to have improved environmental resistances, such as a resistance to ultraviolet rays, a resistance to heat damage, a resistance to humidity, a resistance to moisture, a resistance to abrasion, a resistance to external chemicals, or a combination thereof. For instance, low melt yarns have improved hydrophobic properties compared to polyester or cotton. In some embodiments, one or more portions of the bras 100 of the present disclosure is fabricated to include a continuous fiber. For instance, in some embodiments one or more portions of the bras 100 of the present disclosure is fabricated to include a thermoplastic liquid crystal polymer (e.g., VECTRAN®). In some embodiments, one or more portions of the bras 100 of the present disclosure is fabricated to include a polyethylene naphthalate (e.g., PEN®). In some embodiments, one or more portions of the bras 100 of the present disclosure is fabricated to include a dimensionally stable polymer (e.g., DSP®).

In some embodiments, one or more portions of the bras 100 of the present disclosure is fabricated to include a low melt yarn. Using the circular knitting machine, low melt yarn, or a blend of fabric and low melt yarn, is knitting into respective portions of the bra that provide support to the breasts. In various embodiments, once the circular knitting machine has completed fabrication of the bra 100, the bra is exposed to a heat source that at least partially melts the low melt yarn. Through the exposure of the low melt yarn to the heat source, the low melt yarn gains an improved rigidity, which imparts a shape to the various portions of bra. For instance, the cup regions of the bra 100 are initially fabricated in a tubular or planar manner, and through the exposure to the heat source, and optionally the plurality of lined stitches 1402 and/or 1404, are the shapes of the cups regions formed. In some embodiments, the heat source includes steam. In some embodiments, the heat source includes hot air (e.g., air that has a temperature of at least 50° Celsius (C), at least 60° C., etc.). In some embodiments, the heat source includes electromagnetic waves in the infrared band (e.g., a wavelength of from 700 nanometers to 1 mm). Additionally, in some embodiments the low melt yarn includes a melting point in a range of from 60° C. to 180° C. In some embodiments, the low melt yarn includes a melting point in a range of from 60° C. to 178° C., a melting point in a range of from 60° C. to 178° C., a melting point in a range of from 60° C. to 160° C., a melting point in a range of from 50° C. to 180° C., a melting point in a range of from 60° C. to 150° C., a range of from 60° C. to 100° C., a melting point in a range of from 70° C. to 180° C., a melting point in a range of from 90° C. to 180° C., a melting point in a range of from 100° C. to 178° C., a melting point in a range of from 140° C. to 300° C., or a melting point in a range of from 140° C. to 320° C. Furthermore, in some embodiments exposure to the heat source seals various portions of the bra 100 (e.g., seals, or bonds, an external layer 1604 and internal layer 1602 of a bra together).

In some embodiments, the low melt yarn includes a fusible polyester (e.g., co-polyester) yarn. For instance, in some embodiments the fusible polyester yarn includes a fully drawn polyester (e.g., polyester FDY). In some embodiments, the fusible polyester yarn includes a melting point in a range of from 110° C. to 180° C. or a melting point in a range of from 115° C. to 180° C. In some embodiments, the fusible polyester yarn includes a denier of from 20 denier (D) to 300 D.

In some embodiments, the low melt yarn includes a co-polyamide (CoPa) low melt yarn, including nylon. Accordingly, in some embodiments the nylon low melt yarn includes a melting point in a range of from 105° C. to 125° C., a melting point in a range of from 90° C. to 100° C., or a melting point that is 95° C. Further, in some embodiments of the present disclosure, the nylon low melt yarn includes a denier in a range of from 75 D to 300 D. Furthermore, in some embodiments the low melt yarn includes a partially oriented yarn (POY) and/or a fully oriented yarn (FOY).

In some embodiments, the low melt yarn is or includes a 110 dtex nylon yarn with a melting point of 60° C. In some embodiments, the low melt yarn is or includes a 220 dtex nylon yarn with a melting point in a range of from 55° C. to 65° C. In some embodiments, the low melt yarn is or includes an 83 dtex and 110 dtex filament polyester yarn with a melting point in a range of from 60° C. to 110° C.

Furthermore, in some embodiments the low melt yarn includes a dtex in a range of from 20 dtex to 900 dtex, from 20 dtex to 850 dtex, from 20 dtex to 840 dtex, from 21 dtex to 850 dtex, from 22 dtex to 850 dtex, from 23 dtex to 850 dtex, from 23 dtex to 840 dtex, from 25 dtex to 800 dtex, from 20 dtex to 500 dtex, from 20 dtex to 400 dtex, or from 22 dtex to 400 dtex.

In some embodiments, the low melt yarn includes polyethylene fibers, which has a melting point of approximately 123° C. In some embodiments, the low melt yarn includes polythene, polyolefin, or polyalkene. Furthermore, in some embodiments the low melt yarn includes a 100% polyester low melt yarn.

In some embodiments, the low melt yarn includes a low melting point polyamide (LMPA) that is blended with a filament selected from polyamide (PA), polyethylene terephthalate (PET), and/or polypropylene (PP). In some embodiments, the low melt yarn includes a low melting point polyethylene terephthalate (LMPET) that is blended with a filament selected from polyamide (PA), polyethylene terephthalate (PET), and/or polypropylene (PP). For instance, in some embodiments the low melt yarn includes LMPA/PA fabrics. In some embodiments, the low melt yarn includes a co-polymide (CoPa) and/or a co-polyester (CoPES). In some embodiments, the low melt yarn includes LMPET/PET fabrics. Nevertheless, in some embodiments the LMPA fabric includes a melting point of 110° C., a 108 dtex, and a tensile strength of 2.9 centi-Newtons per dtex (cN/dtex). In some embodiments, the LMPET fabric includes a melting point of 110° C., a 122 dtex, and a tensile strength of 1.9 cN/dtex. In some embodiments, the PA fabric includes a melting point of 210° C., a 372 dtex, and a tensile strength of 3.8 cN/dtex. In some embodiments, the PET fabric includes a melting point of 254° C., a 335 dtex, and a tensile strength of 3.1 cN/dtex. Additionally, in some embodiments the PP fabric includes a melting point of 160° C., a 352 dtex, and a tensile strength of 3.7 cN/dtex.

In some embodiments, the low melt yarn includes a blend of fabrics to provide a fusible combination low melt yarn. For instance, in some embodiments the low melt yarn includes a blend of low melt nylon and a high tenacity polyester carrier fiber that has a melting point above that of the low melt nylon. In some embodiments, the fusible combination low melt yarn includes a melting point in a range of from 75° C. to 150° C., a melting point in a range of from 80° C. to 150° C., a melting point in a range of from 85° C. to 150° C., a melting point in a range of from 90° C. to 150° C., a melting point in a range of from 85° C. to 145° C., a melting point in a range of from 85° C. to 140° C., a melting point in a range of from 85° C. to 130° C., a melting point in a range of from 175° C. to 300° C., a melting point in a range of from 175° C. to 295° C., a melting point in a range of from 175° C. to 290° C., a melting point in a range of from 185° C. to 290° C., a melting point in a range of from 60° C. to 160° C., a melting point in a range of from 60° C. to 200° C., or a melting point in a range of from 185° C. to 280° C.

Furthermore, in some embodiments the fusible combination low melt yarn includes a dtex in a range of from 20 dtex to 1,500 dtex, from 30 dtex to 1,200 dtex, from 35 dtex to 1,150 dtex, from 35 dtex to 1,100 dtex, from 40 dtex to 1,150 dtex, from 40 dtex to 1,100 dtex, from 35 dtex to 1,000 dtex, from 40 dtex to 1,100 dtex, from 45 dtex to 1,150 dtex, from 45 dtex to 1,100 dtex, from 45 dtex to 1,000 dtex, from 50 dtex to 1,150 dtex, from 35 dtex to 1,150 dtex, or from 23 dtex to 1,110 dtex.

Moreover, compared to other fabrics such as wool, cotton, and silk, low melt yarns have relatively low densities. For instance, cotton has density in a range of from 1.5 grams per cubic cm ($g/cm^3$) to 1.54 $g/cm^3$, rayon has density in a range of from 1.46 $g/cm^3$ to 1.54 $g/cm^3$, PLA has density in a range of from 1.25 $g/cm^3$ to 1.27 $g/cm^3$, PES has density in a range of from 1.36 $g/cm^3$ to 1.41 $g/cm^3$, PA has density in a range of from 1.15 $g/cm^3$ to 1.20 $g/cm^3$, SPF has density in a range of from 1.29 $g/cm^3$ to 1.31 $g/cm^3$, silk has density in a range of from 1.32 $g/cm^3$ to 1.38 $g/cm^3$, and wool has density of 1.32 $g/cm^3$. See, Zupin et al., 2010. Accordingly, the bras 100 of the present disclosure that include low melt yarn not only provide a medium to high level of support through for the breasts but also have a relatively low density as compared to bras fabricated of the above described fabrics. This provides bras 100 with exceptional support that are also light weight to wear.

In some embodiments, the low melt yarn includes a number of twists of fabric per meter unit direction (t/m) in a range of from 5 t/m to 350 t/m, from 5 t/m to 300 t/m, from 10 t/m to 275 t/m, from 5 t/m to 250 t/m, from 20 t/m to 300 t/m, from 20 t/m to 200 t/m, from 50 t/m to 200 t/m, from 50 t/m to 150 t/m, from 75 t/m to 150 t/m, or from 80 t/m to 120 t/m (e.g., 100 t/m).

In some embodiments, the low melt yarn includes a bonding yarn and/or fusible yarn as provided by DISTRICO© of 9 rue Mayran, 75009 Paris, France. For instance, in some embodiments the low melt yarn includes K110 as provided by DISTRICO©. In some embodiments, the K110 low melt yarn includes a denier of 55 dtex. Further, in some embodiments the K110 low melt yarn includes twist of 100 t/m Z (e.g., twists per meter in a Z-direction).

As previously described, the present disclosure enables each respective portion of the bra 100 to be fabricated using a different pattern of fabric. As used herein, each respective pattern of fabric is defined by a unique stitching thickness, a unique type of stitching, a unique blend of materials or fabrics, or a combination thereof. For instance, in some embodiments a first pattern of fabric is defined by a first stitching thickness, a first type of stitching, and a first blend of fabrics. Accordingly, a second pattern of fabric is defined by the first stitching thickness, the first type of stitching, and a second blend of fabrics. However, the present disclosure is not limited thereto as one skilled in the art know of a plurality of possible combinations that define a plausible pattern of fabric. Throughout the present disclosure, unless expressly stated otherwise, different hashing of various portions of the bra 100 represent different patterns of fabric. For instance, referring briefly to FIG. 4, in some embodiments a first hashing represents a first pattern of fabric, a second hashing represents a second pattern of fabric (e.g., a pattern of fabric of at least the gore 108, the first gusset 120, and the second gusset 122), a third hashing that represents a third pattern of fabric (e.g., a pattern of fabric of the underband 110), and a fourth hashing that represents a fourth pattern of fabric (e.g., a pattern of fabric of a front portion of the band 102). The hashings of the present disclosure are illustrative in purpose and do not represent explicit combinations of patterns of fabric.

In regard to a thickness of a respective fabric or stitch, the thickness primaryily depends on a diameter of the respective fabric, a length of the stitch, and/or a twist of the respective fabric. Furthermore, an ability of a knitted fabric to withstand an applied stress is dependent upon a type of fabric, a tightness of the fabric during fabrication, a direction and magnitude of the applied stress. See, Kharkova et al., 2011, "Elastic Properties of Cotton Fabric Based Polymer Composites," Engineering for Rural Development (Latvia), Print, which is hereby incorporated by reference in its entirety.

Moreover, since, in some embodiments, the bras 100 of the present disclosure are fabricated in a double layer (e.g., the internal layer 1702 and the external layer 1704 of FIG. 17), each respective portion of the bra includes an internal portion and an external portion that are similarly customizable and fabricated using different patterns of fabric in some embodiments. For instance, as illustrated in FIG. 17, in some embodiments an internal portion 1702 of a respective gusset (e.g., second gusset 122) is formed using a first pattern of fabric and an external portion 1704 of the respective gusset is formed using a second pattern of fabric.

In some embodiments, the unique types of stitching that define a respective pattern of fabric include a pique stitch, a mesh stitch, and/or a rib stitch. In some embodiments, the unique types of stitching further include a fine gauge mesh stitch, a low modulus gusset stitch, a float stitch, and/or a high modulus rib stitch (e.g., a high modulus fabric with a 1 by 1 rib stitch). Each type of stitching provides a unique density of fabric (e.g., a tightness of a respective stitch), imparting not only a toughness and texture on the bra 100 but also a level of support for the respective portion of a given type of stich. For instance, a pique stitch provides a high density knit with a high level of support. Moreover, a mesh stitch, also known as a tuck stitch, provides a knit that is wider and thicker than other knits, while imparting a cellular or matrix texture to the respective portion of the bra 100. Both pique and mesh stitches have improved breathability, allowing for an exchange of fluids between the wearer and the fabric. Further, both pique and mesh stitches have improved (e.g., a higher number further from zero) elastic limits, in which the fabrics deform elastically until retaining a permanent residual stress after an applied stress is relaxed (e.g., plastic deformation). Float stitches provide a knit with a reduced elasticity and increased stitching density (e.g., narrower stitching) since each stitch includes is oriented parallel to the respective layer of the garment. In some embodiments, a rib stitch of the present disclosure is a 1 by 1 rib stitch, which alternates a knit stitch and a purl stich. However, the present disclosure is not limited thereto. In some embodiments, the rib stitch includes a 2 by 2 rib stitch (e.g., alternating two knit stitches and two purl stitches). Additional details and information regarding the types of stitching for respective portions of the bra 100 will be described in more detail infra.

In some embodiments, a first pattern of fabric includes a blend of one or more fibers that includes a low melt yarn fabricated in a pique stitch. In some embodiments, a second pattern of fabric includes a blend of one or more fibers fabricated in a fine gauge mesh stitch. In some embodiments, a third pattern of fabric includes a blend of one or more fibers fabricated in a mesh stitch. In some embodiments, a fourth pattern of fabric includes a blend of one or more fibers fabricated in (e.g., as) a low modulus gusset. In some embodiments, a fifth pattern of fabric includes a blend of one or more fibers fabricated in a 1 by 1 rib stitch.

Accordingly, in some embodiments the gore 108, the first gusset 120, the second gusset 122, an upper end portion of each respective strap 160 and 162 (e.g., portion 1390-1 of the first strap 160 and portion 1390-1 of the second strap 162 of FIG. 13), an upper end portion of the back portion of the band 102 (e.g., upper portion 590-2 of FIG. 5), a lower end portion of the back portion of the band (e.g., lower end portion 590-1 of FIG. 5), or a combination thereof is formed at least in part with a pique stitch. In some embodiments, an upper end portion of the front of the band 102 (e.g., upper portion 390-3 of FIG. 3) and/or the upper end portion 590-2 of the back portion of the band is formed at least in part with a fine gauge mesh stitch.

Generally, the upper end portions 1390-1 and 1390-2 of the respective straps 160 and 162 dampen movement of the breasts in an upwardly motion, whereas the cup regions 105 and 106 generally damping movement of the breasts in a downwardly and/or lateral motion. Thus, the combination of the upper end portions 1390-1 and 1390-2 of the respective straps 160 and 162 and the cup regions 104 and 106 dampen movement of the breasts in a plurality of directions.

Furthermore, in some embodiments a transition from a first type of stitch of a first portion of the bra 100 to a second type of stitch of a second portion of the bra is a discrete transition, such that a defined boundary exists between the first portion and the portion of the bra (e.g., a transition from the upper end portion 590-2 of the back portion of the band 102 to the lower end portion 590-1 of the back portion of the band of FIG. 5 in which a defined boundary exists between the two respective regions). However, the present disclosure is not limited thereto. In some embodiments the transition from the first type of stitch of the first portion of the bra 100 to the second type of stitch of the second portion of the bra is a gradient transition, such that transition between the first portion and the second occurs over a length of the bra. For instance, referring briefly to FIG. 11, in some embodiments a transition from a first portion 1190-1 of the front of the band 102 to the lower end portion 590-1 of the back portion of the band is a gradient transition, whereas, referring briefly to FIG. 12, in other embodiments the transition from the first portion 1190-1 of the front of the band 102 to the lower end portion 590-1 of the back portion of the band is discrete transition.

In some embodiments, a front portion of the underband 110 includes a first fabric with a first Young's modulus and a back portion of the underband includes a second fabric with a second Young's modulus that is less than the first Young's modulus. This difference in Young's modulus between the front portion and the back portion allows for the front portion of the underband 110 to have a greater extensibility and provide improved support for the breasts of the wearer, such as an improved cantilever support of the breast. Further, in some embodiments the front portion and the back portion of the underband 110 include a rib stitch.

Furthermore, in some embodiments, alongside varying a respective pattern of fabric, a density of stitching is configurable to allow for various rigidities and extensibilities between various portions of a respective component of the bra 100. Generally, a decrease in stitching density (e.g., a smaller distance between parallel stitches or respective lines of stitches) yields a less rigid product. Varying the density of stitching of a pattern of fabric for a respective portion of the bra 100 allows for the respective portion of the bra to varyingly deform and dynamically support the breasts of the wearer of the bra. For instance, with respect to the cup regions 104 and 106 of the bra 100, in some embodiments it is desirable to vary the density of stitching of the respective cup region such that the cup region is formed with a first density of stitching at a base of the cup region (e.g., proximate to the underband 110) and a second density of stitching, less than the first density of stitching, at an upper end portion of the cup region. In some embodiments, the density of stitching decreases in a linear gradient of stitching density from the base of the respective cup to the top of the respective cup. In other embodiments, the density of stitching decreases in a non-linear gradient of stitching density from the base of the respective cup to the top of the respective cup.

Referring briefly to FIG. 3, an exemplary variety of stitching densities 380 is illustrated with respect to the first cup region 104. In some implementation, the density of stitching decreases from a first density 380-1 at a first portion of the respective cup at the base of the respective cup to a second density 380-2 at a second portion of the respective cup at the top of the respective cup. In some embodiments, the respective cup includes a third portion between the first portion and the second portion of the respective cup that is stitched at a third density 380-3. In some embodiments, the third density is between first density 390-1 and the second density 380-2. In some embodiments, the respective cup includes a fourth portion between the third portion and the second portion of the respective cup that is stitched at a fourth density. Accordingly, in some embodiments the fourth density is between the third density 380-3 and the second density 380-2. However, the present disclosure is not limited thereto as one skilled in the art can envision any combination and arrangements of stitching densities.

In some embodiments, the first density 380-1 is a blend of fibers that includes a low melt yarn in a range of from 100% to 80% of the blend, in a range of from 100% to 60% of the blend, in a range of from 90% to 60% of the blend, in a range of from 80% to 70% of the blend, in a range of from 70% to 60% of the blend, in a range of from 60% to 50% of the blend, in a range of from 100% to 80% of the blend, in a range of from 100% to 50% of the blend, in a range of from 50% to 10% of the blend, or in a range of from 60% to 5% of the blend.

In some embodiments, the second density 380-2 is a blend of fibers that includes a low melt yarn in a range of from 90% to 80% of the blend, in a range of from 95% to 60% of the blend, in a range of from 90% to 60% of the blend, in a range of from 80% to 70% of the blend, in a range of from 70% to 60% of the blend, in a range of from 60% to 50% of the blend, in a range of from 100% to 80% of the blend, a range of from 100% to 50% of the blend, a range of from 50% to 10% of the blend, or a range of from 60% to 10% of the blend.

In some embodiments, the third density 380-3 is a blend of fibers that includes a low melt yarn in a range of from 90% to 80% of the blend, a range of from 95% to 60% of the blend, a range of from 90% to 60% of the blend, a range of from 80% to 70% of the blend, a range of from 70% to 60% of the blend, a range of from 60% to 50% of the blend, a range of from 100% to 80% of the blend, a range of from 100% to 50% of the blend, a range of from 50% to 10% of the blend, or a range of from 60% to 10% of the blend.

In some embodiments, the fourth density is a blend of fibers that includes a low melt yarn in a range of from 90% to 80% of the blend, a range of from 95% to 60% of the blend, a range of from 90% to 60% of the blend, a range of from 80% to 70% of the blend, a range of from 70% to 60% of the blend, a range of from 60% to 50% of the blend, a range of from 100% to 80% of the blend, a range of from 100% to 50% of the blend, a range of from 50% to 10% of the blend, or a range of from 60% to 10% of the blend.

Referring briefly to FIG. 13, in some embodiments, an upper portion of each of the first strap 160 and/or the second strap 162 (e.g., portions 1390-1 and 1390-2) is formed from the first pattern of fabric. In some embodiments, the upper portion of each of the first strap 160 and/or the second strap 162 is formed from the second pattern of fabric. In some embodiments, the upper portion of each of the first strap 160 and/or the second strap 162 is formed from the third pattern of fabric. In some embodiments, the upper portion of each of the first strap 160 and/or the second strap 162 is formed from the fourth pattern of fabric. In various embodiments in which both the upper portions 1390-1 and 1390-2 of the straps 160 and 162 as well as portion of each respective cup region 104 and 106 are fabricated using a pattern of fabric with a high rigidity (e.g., includes a low melt yarn), the straps and the cup regions combine to form an equilibrium of support for the prevents to dampen movement of the breasts in an upwardly motion, a downwardly motion, and a lateral motion.

In some embodiments, an upper end portion of the back portion of the bra 100 (e.g., a back portion of the band 102) is formed from the first pattern of fabric. In some embodiments, the upper end portion of the back portion of the bra 100 is formed from the second pattern of fabric. In some embodiments, the upper end portion of the back portion of the bra 100 is formed from the third pattern of fabric. In some embodiments, the upper end portion of the back portion of the bra 100 is formed from the fourth pattern of fabric. Additionally, a bottom portion of the back portion of the bra is formed from a fifth pattern of fabric.

In some embodiments, the neckline portion is formed from the first pattern of fabric. In some embodiments, the neckline portion is formed from the second pattern of fabric. In some embodiments, the neckline portion is formed from the third pattern of fabric. In some embodiments, the neckline portion is formed from the fourth pattern of fabric. In some embodiments, the neckline portion is formed from the fifth pattern of fabric. Further, in some embodiments the neckline portion is formed from a sixth pattern of fabric.

In some embodiments, the first gusset 120 and/or the second gusset 122 is formed from the first pattern of fabric. In some embodiments, the first gusset 120 and/or the second gusset 122 is formed from the second pattern of fabric. In some embodiments, the first gusset 120 and/or the second gusset 122 is formed from the third pattern of fabric. In some embodiments, the first gusset 120 and/or the second gusset 122 is formed from the fourth pattern of fabric. In some embodiments, the first gusset 120 and/or the second gusset 122 is formed from the fifth pattern of fabric.

In some embodiments, the sixth gusset 320 is formed from a seventh pattern of fabric. In some embodiments, the seventh pattern of fabric has a modulus that is lower than that of the third pattern of fabric.

In some embodiments, the gore 108 is formed from an elastic fabric such as an elastic yarn knit. In some embodiments, the gore 108 is formed from a relatively inelastic fabric, such as cotton or silk. In some embodiments, the gore 108 is formed from the first pattern of fabric. In some embodiments, the gore 108 is formed from the second pattern of fabric. In some embodiments, the gore 108 is formed from the third pattern of fabric. In some embodiments, the gore 108 is formed from the fourth pattern of fabric. In some embodiments, the gore 108 is formed from the fifth pattern of fabric.

Example 1—a First Seamless Pullover Bra

A bra 100 includes a band 102 that wraps around a torso of a wearer. The band 102 is defined by a back portion, a first underarm portion, a second underarm portion, and a front portion. The front portion and the back portion are connected to each other through both of the first underarm portion and the second underarm portion.

The back portion includes a first portion 590-1 that is fabricated using a mesh stitch, a second portion 590-2 that is fabricated using a mesh stitch, and a third portion 1590-1 that is fabricated using a fine gauge mesh stitch, allowing an exchange of fluids between the wearer and an external environment (e.g., a breathable fabric).

The front portion includes a first cup region 104 and a second cup region 106 that accommodate a respective breast of the wearer. Each cup region 104 and 106 is fabricated with a fabric that includes a blend of at least a first fabric and a low melt yarn. Further, each cup region is fabricated with a stitching density that decreases from a first density 380-1 at a base of the respective cup region, through a third density 380-3, to a second density 380-2 at an upper end portion of the respective cup region.

Additionally, a gore 108 is formed between the first cup region 104 and the second cup region 106, which adjoins the respective cup regions together. The gore 108 is fabricated using a pique stitch that includes a low melt yarn.

Additionally, an underband 110 is formed by the bottom portion of the bra that runs below each of the gore 108, the first cup region 104, and the second cup region 106. A first strap 160 adjoins the first cup region 104 and a first portion of the back portion of the band 102. Similarly, a second strap 162 adjoins the second cup region 106 and a second portion of the back portion of the band 102. Both of the first strap 160 and the second strap 162 are fabricated using a fine gauge mesh stitch, and further includes an upper end portion 1390-1 and 1930-2, respectively, that is fabricated using a pique stitch and a blend of fabric that includes a low melt yarn. Furthermore, a neckline portion runs above the first cup region 104 and the second cup region 106 and also runs between a first portion of the first strap 160 and a first portion of the second strap 162.

Example 2—a Second Seamless Pullover Bra

A bra 100 includes a band 102 that wraps around a torso of a wearer. The band 102 is defined by a back portion, a first underarm portion, a second underarm portion, and a front portion. The front portion and the back portion are connected to each other through both of the first underarm portion and the second underarm portion.

The back portion includes a first portion 590-1 that is fabricated using a mesh stitch, a second portion 590-2 that is fabricated using a mesh stitch, and a third portion 1590-1 that is fabricated using a fine gauge mesh stitch, allowing an exchange of fluids between the wearer and an external environment (e.g., a breathable fabric).

The front portion includes a first cup region 104 and a second cup region 106 that accommodate a respective breast of the wearer. Each cup region 104 and 106 is fabricated with a fabric that includes a blend of at least a first fabric and a low melt yarn. Further, each cup region is fabricated with a stitching density that decreases from a first density 380-1 at a base of the respective cup region, through a third density 380-3, to a second density 380-2 at an upper end portion of the respective cup region.

Additionally, a gore 108 is formed between the first cup region 104 and the second cup region 106, which adjoins the respective cup regions together. Furthermore, each of the first cup region 104 and the second cup region 106 includes a respective gusset, 120 and 122 respective, that is formed at an outer edge portion of the respective cup region proximate to the respective underarm portion. Each of the gore 108 and the gussets 120 and 122 is fabricated using a pique stitch that includes a low melt yarn.

Additionally, an underband 110 is formed by the bottom portion of the bra that runs below each of the gore 108, the first cup region 104, and the second cup region 106. A first strap 160 adjoins the first cup region 104 and a first portion of the back portion of the band 102. Similarly, a second strap 162 adjoins the second cup region 106 and a second portion of the back portion of the band 102. Both of the first strap 160 and the second strap 162 are fabricated using a fine gauge mesh stitch, and further includes an upper end portion 1390-1 and 1930-2, respectively, that is fabricated using a pique stitch and a blend of fabric that includes a low melt yarn. Furthermore, a neckline portion runs above the first cup region 104 and the second cup region 106 and also runs between a first portion of the first strap 160 and a first portion of the second strap 162.

Example 3—A Third Seamless Pullover Bra

A bra 100 includes a band 102 that wraps around a torso of a wearer. The band 102 is defined by a back portion, a first underarm portion, a second underarm portion, and a front portion. The front portion and the back portion are connected to each other through both of the first underarm portion and the second underarm portion.

The back portion includes a first portion 590-1 that is fabricated using a mesh stitch and a second portion 590-2 that is fabricated using a mesh stitch.

The front portion includes a first cup region 104 and a second cup region 106 that accommodate a respective breast of the wearer. Each cup region 104 and 106 is fabricated with a fabric that includes a blend of at least a first fabric and a low melt yarn. Further, each cup region is fabricated with a stitching density that decreases from a first density 380-1 at a base of the respective cup region, through a third density 380-3, to a second density 380-2 at an upper end portion of the respective cup region.

Additionally, a gore 108 is formed between the first cup region 104 and the second cup region 106, which adjoins the respective cup regions together. Furthermore, each of the first cup region 104 and the second cup region 106 includes a respective gusset, 120 and 122 respective, that is formed at an outer edge portion of the respective cup region proximate to the respective underarm portion. Each of the gore 108 and the gussets 120 and 122 is fabricated using a pique stitch that includes a low melt yarn.

Additionally, an underband 110 is formed by the bottom portion of the bra that runs below each of the gore 108, the first cup region 104, and the second cup region 106. A first strap 160 adjoins the first cup region 104 and a first portion of the back portion of the band 102. Similarly, a second strap 162 adjoins the second cup region 106 and a second portion of the back portion of the band 102. Both of the first strap 160 and the second strap 162 are fabricated using a fine gauge mesh stitch, and further includes an upper end portion 1390-1 and 1930-2, respectively, that is fabricated using a pique stitch and a blend of fabric that includes a low melt yarn. Furthermore, a neckline portion runs above the first cup region 104 and the second cup region 106 and also runs between a first portion of the first strap 160 and a first portion of the second strap 162.

Example 4—A Fourth Seamless Pullover Bra

A bra 100 includes a band 102 that wraps around a torso of a wearer. The band 102 is defined by a back portion, a first underarm portion, a second underarm portion, and a front portion. The front portion and the back portion are connected to each other through both of the first underarm portion and the second underarm portion.

The back portion includes a first portion 590-1 that is fabricated using a mesh stitch and a second portion 590-2 that is fabricated using a mesh stitch.

The front portion includes a first cup region 104 and a second cup region 106 that accommodate a respective breast of the wearer. Each cup region 104 and 106 is fabricated with a fabric that includes a blend of at least a first fabric and a low melt yarn. Further, each cup region is fabricated with a stitching density that decreases from a first density 380-1 at a base of the respective cup region, through a third density 380-3, to a second density 380-2 at an upper end portion of the respective cup region.

Additionally, a gore 108 is formed between the first cup region 104 and the second cup region 106, which adjoins the respective cup regions together. Furthermore, each of the first cup region 104 and the second cup region 106 includes a respective gusset, 120 and 122 respective, that is formed at an outer edge portion of the respective cup region proximate to the respective underarm portion. Each of the gore 108 and the gussets 120 and 122 is fabricated using a pique stitch that includes a low melt yarn.

Additionally, an underband 110 is formed by the bottom portion of the bra that runs below each of the gore 108, the first cup region 104, and the second cup region 106. A first strap 160 adjoins the first cup region 104 and a first portion of the back portion of the band 102. Similarly, a second strap 162 adjoins the second cup region 106 and a second portion of the back portion of the band 102. Both of the first strap 160 and the second strap 162 are fabricated using a fine gauge mesh stitch, and further includes an upper end portion 1390-1 and 1930-2, respectively, that is fabricated using a pique stitch and a blend of fabric that includes a low melt yarn. Furthermore, a neckline portion runs above the first cup region 104 and the second cup region 106 and also runs between a first portion of the first strap 160 and a first portion of the second strap 162.

Example 5—Fabricating an Exemplary Bra

A digital pattern of a bra 100 is provided to a controller of a circular knitting machine. The digital pattern (e.g., a bitmap of the bra) specifics combinations of fabrics and stitching parameters to be used at various portions of the bra 100. Accordingly, the circular knitting machine fabricates the bra 100 in a generally tubular shape in accordance with the digital pattern. Once the bra 100 is fabricated by the circular knitting machine, a heat source is applied to particular portions of the bra 100 that includes a low melt yarn. The heat source at least partially melts and bonds the low melt yarn, which increases a rigidity of the respective portion, thereby increases an amount of support (e.g., resistance to deformation) of the respective portion.

REFERENCES CITED

All referenced cited herein are incorporated herein by reference in their entirety and for all purposes to the same extent as if each individual publication or patent or patent application was specifically and individually indicated to be incorporated by reference in its entirety for all purposes.

What is claimed is:

1. A pullover bra comprising:

a band configured to wrap around a torso, wherein the band comprises:

(i) a back portion, (ii) a first underarm portion, (iii) a second underarm portion, (iv) a front portion, wherein the front portion is connected to the back portion through both the first underarm portion and the second underarm portion, and wherein the front portion comprises a first cup region, a second cup region, and a gore between the first cup region and the second cup region, the gore adjoining the first cup region and the second cup region, and wherein each respective cup region in a set consisting of the first cup region and the second cup region is formed with a density of stitching that decreases from a base of the respective cup region to a top of the respective cup region, and (v) an underband formed by a bottom portion of the bra, the underband running below the gore, the first cup region, and the second cup region;

a first strap adjoining the first cup region and a first portion of the back portion of the band;

a second strap adjoining the second cup region and a second portion of the back portion of the band; and a neckline portion running above the first cup region and the second cup region and running between a first portion of the first strap and a first portion of the second strap, and wherein, each of the gore, the first underarm portion, and the second underarm portion is comprises a first pattern of fabric, each of the back portion of the bra, the first strap, the second strap, and the neckline portion comprises a second pattern of fabric, and the underband comprises a third pattern of fabric.

2. The bra of claim 1, wherein the density of stitching decreases as a linear or nonlinear gradient of stitching density from the base of the respective cup region to the top of the respective cup region.

3. The bra of claim 1, wherein the density of stitching decreases from a first density at a first portion of the respective cup region at the base of the respective cup region to a second density at a second portion of the respective cup region at the top of the respective cup region.

4. The bra of claim 3, wherein the respective cup region includes a third portion between the first portion and the second portion of the respective cup region that is stitched at a third density, wherein the third density is between the first density and the second density.

5. The bra of claim 4, wherein the respective cup region includes a fourth portion between the third portion and the second portion of the respective cup region that is stitched at a fourth density, wherein the fourth density is between the third density and the second density.

6. The bra of claim 1, wherein a top portion of each of the first strap and the second strap is formed from the first pattern of fabric.

7. The bra of claim 1, wherein a top portion of each of the first strap and the second strap is formed from a fourth pattern of fabric.

8. The bra of claim 7, wherein the first pattern of fabric, the second pattern of fabric, the third pattern of fabric, and the fourth pattern of fabric are each independently defined by a unique stitching thickness, a unique type of stitching, a blend of material, or a combination thereof.

9. The bra of claim 1, wherein:

an upper portion of the back of the bra is formed from the second pattern of fabric, and a bottom portion of the back of the bra is formed from a fifth pattern of fabric.

10. The bra of claim 9, wherein the first pattern of fabric, the second pattern of fabric, the third pattern of fabric, the fourth pattern of fabric, and the fifth pattern of fabric are each independently defined by a unique stitching thickness, a unique type of stitching, a blend of material, or a combination thereof.

11. The bra of claim 9, wherein the neckline portion is formed from the fifth pattern of fabric.

12. The bra of claim 1, wherein the neckline portion is formed from a sixth pattern of fabric.

13. The bra of claim 12, wherein the first pattern of fabric, the second pattern of fabric, the third pattern of fabric, the fourth pattern of fabric, the fifth pattern of fabric, and the sixth pattern of fabric is each independently defined by a unique stitching thickness, a unique type of stitching, a blend of material, or a combination thereof.

14. The bra of claim 1, wherein:

a first gusset is formed at an outer edge portion of the first cup region proximate to the first underarm portion, and a second gusset is formed at an outer edge portion of the second cup region proximate to the second underarm portion.

15. The bra of claim 14, wherein each of the first gusset and the second gusset is formed from the first pattern of fabric.

16. The bra of claim 1, wherein an auxiliary gusset is formed adjoining the underband to the back portion, the first underarm portion, the second underarm portion, and front portion of the bra.

17. The bra of claim 16, wherein the auxiliary gusset is formed from a seventh pattern of fabric, the seventh pattern of fabric having a modulus that is lower than that of the third pattern of fabric.

18. The bra of claim 17, wherein the first pattern of fabric, the second pattern of fabric, the third pattern of fabric, the fourth pattern of fabric, the fifth pattern of fabric, the sixth pattern of fabric, and the seventh pattern of fabric is each independently defined by a unique stitching thickness, a unique type of stitching, a blend of material, or a combination thereof.

19. The bra of claim 17, wherein the first pattern of fabric, the second pattern of fabric and the third pattern of fabric is each independently defined by a unique stitching thickness, a unique type of stitching, a blend of material, or a combination thereof.

20. The bra of claim 18, wherein the unique type of stitching is selected from the group consisting of a pique stitch, a mesh stitch, and a rib stitch.

21. The bra of claim 18, wherein each of the first bra cup region and the second bra cup region is formed from a blend of material that includes low melt yarn.

22. The bra of claim 1, wherein the bra is manufactured using a circular kitting machine in a continuous uninterrupted process.

23. The bra of claim 1, wherein the bra is formed as a seamless bra.

* * * * *